US010280018B2

(12) United States Patent
Kondo

(10) Patent No.: US 10,280,018 B2
(45) Date of Patent: May 7, 2019

(54) SHEET FEEDING APPARATUS AND IMAGE FORMING APPARATUS

(71) Applicant: CANON KABUSHIKI KAISHA, Tokyo (JP)

(72) Inventor: Takashi Kondo, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/240,153

(22) Filed: Aug. 18, 2016

(65) Prior Publication Data

US 2017/0066608 A1 Mar. 9, 2017

(30) Foreign Application Priority Data

Sep. 7, 2015 (JP) ..... 2015-175816

(51) Int. Cl.

*B65H 3/06* (2006.01)
*B65H 1/04* (2006.01)
*B65H 3/34* (2006.01)

(52) U.S. Cl.

CPC ..... *B65H 3/0669* (2013.01); *B65H 1/04* (2013.01); *B65H 3/0684* (2013.01); *B65H 3/34* (2013.01); *B65H 2403/42* (2013.01); *B65H 2403/512* (2013.01); *B65H 2403/513* (2013.01); *B65H 2404/1521* (2013.01); *B65H 2405/324* (2013.01); *B65H 2407/21* (2013.01); *B65H 2601/26* (2013.01); *B65H 2801/06* (2013.01)

(58) Field of Classification Search

CPC ..... B65H 1/04; B65H 3/0684; B65H 5/062; B65H 2404/1521; B65H 2404/16; B65H 2405/10; B65H 3/0669

USPC ..... 271/121, 114, 117, 118, 245, 246

See application file for complete search history.

(56) References Cited

U.S. PATENT DOCUMENTS 6,152,631 A * 11/2000 Park ..... B41J 13/103 271/10.03
7,595,916 B2 * 9/2009 Morimoto ..... B65H 3/0669 271/117

(Continued)

FOREIGN PATENT DOCUMENTS

JP 06-115748 A 4/1994
JP 2002-193469 A 7/2002

(Continued)

OTHER PUBLICATIONS

Japanese Office Action issued in corresponding Japanese Application No. 2015175816 dated Aug. 15, 2017.

*Primary Examiner* — Thomas A Morrison
(74) *Attorney, Agent, or Firm* — Venable LLP

(57) ABSTRACT

A sheet feeding apparatus includes a sheet regulation member, a lock portion, and a damper portion. The sheet regulation member is changeable between a regulation posture to regulate a sheet supported on a supporting portion not to enter a separation nip portion and a retracted posture to allow the sheet to enter the separation nip portion. The lock portion locks the sheet regulation member in the regulation posture. In a case where external force equal to or more than a predetermined amount is applied to the sheet regulation member toward the downstream in the sheet feeding direction with the sheet regulation member is locked by the lock portion in the regulation posture, the damper portion allows displacement of the sheet regulation member.

17 Claims, 14 Drawing Sheets

(56) References Cited

U.S. PATENT DOCUMENTS

| | | | | |
|---|---|---|---|---|
| 7,686,291 | B2 * | 3/2010 | Miyazawa | B65H 3/06 271/117 |
| 8,052,139 | B1 * | 11/2011 | Su | B65H 3/0684 271/109 |
| 8,118,299 | B2 * | 2/2012 | Sato | B65H 3/0684 271/117 |
| 8,210,520 | B2 * | 7/2012 | Su | B65H 3/0684 271/109 |
| 2008/0265487 | A1 * | 10/2008 | Butikofer | B65H 3/0684 271/110 |
| 2017/0008712 | A1 * | 1/2017 | Tateishi | B65H 3/0684 |

FOREIGN PATENT DOCUMENTS

| | | | |
|---|---|---|---|
| JP | 2012-020821 | A | 2/2012 |
| JP | 2014-189342 | A | 10/2014 |

* cited by examiner

SHEET FEEDING APPARATUS AND IMAGE FORMING APPARATUS

BACKGROUND OF THE INVENTION

Field of the Invention

This disclosure relates to a sheet feeding apparatus for feeding a sheet, and an image forming apparatus equipped with the sheet feeding apparatus.

Description of the Related Art

Conventionally a sheet feeding apparatus that includes a manual feed tray, on which a sheet is set manually by users, is widely used as a document feeding apparatus or a manual sheet feeding apparatus provided in an image forming apparatus such as a facsimile, a printer, and a copier. In many cases, such a sheet feeding apparatus includes a leading-edge positioning member such as a shutter to regulate a position of the leading edge of the sheet in a sheet feeding direction.

Japanese Patent Laid-Open No. 06-115748 discloses an automatic sheet feeding apparatus in which a stopper is provided between a feed roller and a separation roller to be movable in a vertical direction perpendicular to a sheet surface. The stopper is biased downward by the compression spring, which is inserted to a concaved guide portion of a structural member and arranged to abut against the ceiling of the concaved guide portion with the upper end of the spring, while abutting against the upper end of the stopper with the lower end of the spring. The stopper thus regulates the number of sheets among the sheets on a document tray to be fed to the separation roller disposed downstream of the stopper.

However, in such a configuration, the leading edge of a sheet bundle may strongly abut against the stopper in such a case where a user vigorously sets the sheet bundle onto the document tray. Then, there is a concern that the stopper may be damaged, or the leading edge of the abutting sheet may be buckled.

SUMMARY OF THE INVENTION

According to an aspect of this disclosure, a sheet feeding apparatus includes an apparatus body, a supporting portion held by the apparatus body and configured to support a sheet, a feed portion configured to feed the sheet supported on the supporting portion, a conveyance portion disposed downstream of the feed portion in a sheet feeding direction, a separation portion disposed in pressure contact with the conveyance portion and configured to separate sheets fed from the feed portion one by one in a separation nip portion formed between the conveyance portion and the separation portion, a sheet regulation member disposed upstream of the separation nip portion in the sheet feeding direction, the sheet regulation member being configured to take a regulation posture to regulate the sheet on the supporting portion not to enter the separation nip portion and a retracted posture to allow the sheet on the supporting portion to enter the separation nip portion, a lock portion configured to lock the sheet regulation member in the regulation posture, and a damper portion configured to allow the sheet regulation member locked in the regulation posture by the lock portion to be displaced if external force in the sheet feeding direction and equal to or more than a predetermined amount is applied to the sheet regulation member.

According to another aspect of this disclosure, a sheet feeding apparatus includes an apparatus body, a supporting portion held by the apparatus body and configured to support a sheet, a feed roller configured to feed the sheet supported on the supporting portion, a conveyance roller disposed downstream of the sheet feed portion in a sheet feeding direction, a feed holder configured to hold the feed roller and pivotally supported by the apparatus body between an approach position where the feed roller approaches the supporting portion and a separation position where the feed roller is separated from the supporting portion with respect to the approach position, an engagement member configured to engage with the feed holder to move the feed holder, a resilient member disposed between the engagement member and the feed holder, a separation roller disposed in pressure contact with the conveyance roller and configured to separate sheets fed from the feed roller one by one with a separation nip portion formed between the conveyance roller and the separation roller, a sheet regulation member held by the feed holder and disposed upstream of the separation nip portion in the sheet feeding direction, the sheet regulation member being configured to take a regulation posture to regulate the sheet on the supporting portion not to enter the separation nip portion and a retracted posture to allow the sheet on the supporting portion to enter the separation nip portion, and a lock member configured to lock the sheet regulation member in the regulation posture with the feed holder at the separated position and to release locking of the sheet regulation member in the regulation posture if the feed holder is rotated from the separation position to the approach position. In a case where the sheet regulation member is locked in the regulation posture by the lock portion, the resilient member is elastically deformed if external force in the sheet feeding direction and equal to or more than a predetermined amount is applied to the sheet regulation member.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Now, embodiments of the present disclosure will be described with reference to the drawings. It is noted that in the following description, a state in which an image forming apparatus is seen from a front side, i.e., viewpoint of FIG. 1, is used as reference to describe positional relationships in vertical and left-and-right directions.

First Embodiment

Figure 1:
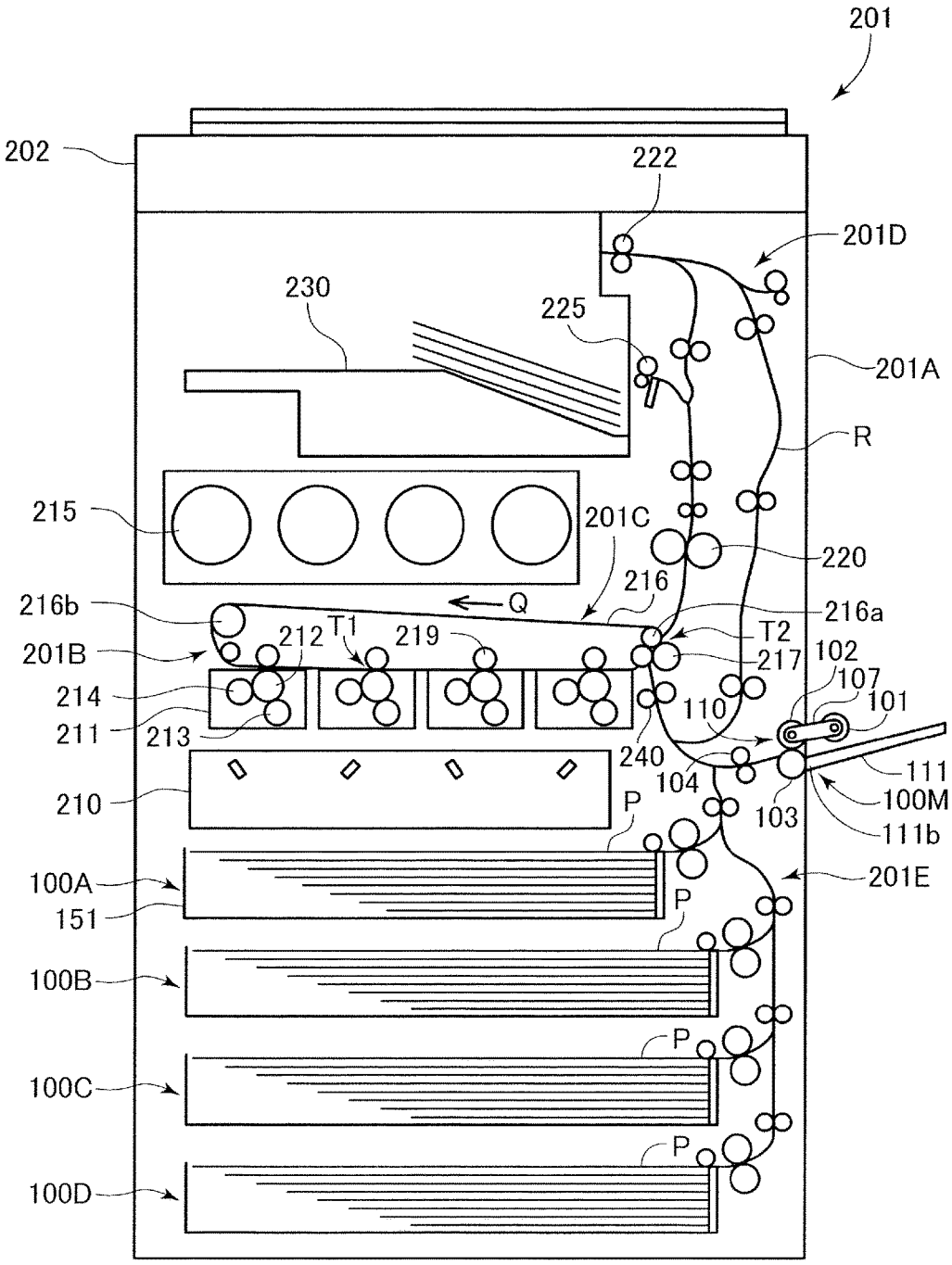
FIG. 1 is a section view schematically illustrating a laser beam printer as an image forming apparatus including a sheet feeding apparatus according to a first embodiment of this disclosure.

An image forming apparatus 201 according to the first embodiment is an image forming apparatus such as a full-color laser printer, a general arrangement of which is illustrated in FIG. 1. The image forming apparatus 201 includes an image forming unit 201B that forms an image on a sheet P and a fixing portion 220 that fixes an image on the sheet P, in an interior of an apparatus body 201A, i.e., a printer body or an image forming apparatus body. An image reading apparatus 202 reading image data of a document is arranged above the apparatus body 201A in a posture in which a supporting surface of the document is positioned approximately horizontally. A sheet discharge tray 230 is provided in a discharge space to which the sheet P is discharged between the image reading apparatus 202 and the apparatus body 201A. Further, a sheet feeding unit 201E feeding sheets P to the image forming unit 201B is provided in the apparatus body 201A. The sheet feeding unit 201E includes sheet feeding apparatuses 100A, 100B, 100C, and 100D arranged vertically at a lower portion of the apparatus body 201A, and a manual sheet feeding apparatus 100M arranged at a right side portion of the apparatus body 201A. The sheet feeding apparatuses 100A, 100B, 100C, and 100D respectively include sheet feeding cassettes 151.

The manual sheet feeding apparatus 100M includes a rotation base 111*b* pivotally supported by the apparatus body 201A and a manual feed tray 111 on which the sheet P is manually stacked. The manual sheet feeding apparatus 100M is provided with a separation conveyance portion 110 including a conveyance roller 102, and a retard roller 103, i.e., a separation member, which rollers contact with each other. Still further, the manual sheet feeding apparatus 100M is provided with a pickup roller 101, i.e., a feed roller, coupled with the conveyance roller 102 through a feed holder 107, and a drawing roller pair 104 positioned downstream of the separation conveyance portion 110 in a sheet feeding direction. The conveyance roller 102 is positioned downstream of the pickup roller 101 in the sheet feeding direction (a direction of an arrow H in FIG. 2A). The retard roller 103 is arranged to be in pressure contact with the conveyance roller 102 to form a separation nip portion N1 (see FIG. 2A) and configured to separate sheets (P) fed by the pickup roller 101 one by one. It is noted that although the retard roller 103 is used as a non-limiting example of the separation member in the present embodiment, a separation pad may be used as another example of the separation member/portion.

The image forming unit 201B is a so-called four-drum full-color image forming unit having a laser scanner 210, four process cartridges 211, and an intermediate transfer unit 201C. The process cartridges form toner images of respective colors, which are yellow (Y), magenta (M), cyan (C) and black (K). Each process cartridge 211 includes a photoconductive drum 212, i.e., image bearing member, a charger 213, i.e., a charging unit, a developer 214, i.e., an image developing unit, and a cleaner, i.e., a cleaning unit (not illustrated). It is noted that a toner cartridge 215 storing toners of respective colors is drawably attached to the apparatus body 201A at an upper portion of the image forming unit 201B.

The intermediate transfer unit 201C includes an intermediate transfer belt 216, i.e., intermediate transfer body, wound around a drive roller 216*a* and a tension roller 216*b*, and the unit is arranged above the four process cartridges 211. The intermediate transfer belt 216 is arranged to contact the photoconductive drums 212 of the respective process cartridges 211, and driven to rotate in a counterclockwise direction, i.e., direction of arrow Q, by the drive roller 216*a* driven by a drive unit (not illustrated). The intermediate transfer unit 201C has primary transfer rollers 219 that contact an inner peripheral surface of the intermediate transfer belt 216 at positions opposing to the respective photoconductive drums 212, and primary transfer portions T1 are formed as nip portions of the intermediate transfer belt 216 and the photoconductive drums 212. Further, the image forming unit 201B includes a secondary transfer roller 217 that contacts an outer peripheral surface of the intermediate transfer belt 216 at a position opposing to the drive roller 216*a*. A secondary transfer portion T2 where a toner image borne on the intermediate transfer belt 216 is transferred to the sheet P is formed as a nip portion of the secondary transfer roller 217 and the intermediate transfer belt 216.

In the respective process cartridges 211 arranged as described, an electrostatic latent image is formed on the surface of the photoconductive drum 212 by the laser scanner 210, and toner is supplied from the developers 214 to form toner images of respective colors charged with negative polarity. The toner images are sequentially transferred in multi layers, i.e., primarily transferred, to the intermediate transfer belt 216 at the respective primary transfer portions T1 by applying a transfer bias voltage of positive polarity to the primary transfer rollers 219, and a full-color toner image is formed on the intermediate transfer belt 216.

Simultaneously as the above-described toner image forming process, the sheet P fed from the sheet feeding unit 201E is conveyed toward a registration roller pair 240, where skewing of the sheet P is corrected by the registration roller pair 240. The registration roller pair 240 conveys the sheet P to the secondary transfer portion T2 at a timing matching the transfer timing of the full-color toner image formed on the intermediate transfer belt 216. The toner image borne on the intermediate transfer belt 216 is secondarily transferred to the sheet P at the secondary transfer portion T2 by applying a transfer bias voltage of positive polarity to the secondary transfer roller 217.

The sheet P to which the toner image has been transferred is heated and pressed by the fixing portion 220, and a color image is fixed onto the sheet P. The sheet P with the fixed image is discharged by a sheet discharge roller pair 225 to the sheet discharge tray 230 and supported on the tray. It is noted that, when images are to be formed on both sides of the sheet P, the sheet P having passed the fixing portion 220 is switched back by a reverse conveyance roller pair 222 capable of forward/reverse rotation provided in a reverse conveyance portion 201D. Thereafter, the sheet P is conveyed again to the image forming unit 201B via a re-transport path R, so as to form an image on the backside of the sheet P.

Configuration of Manual Sheet Feeding Apparatus

Figure 2A:
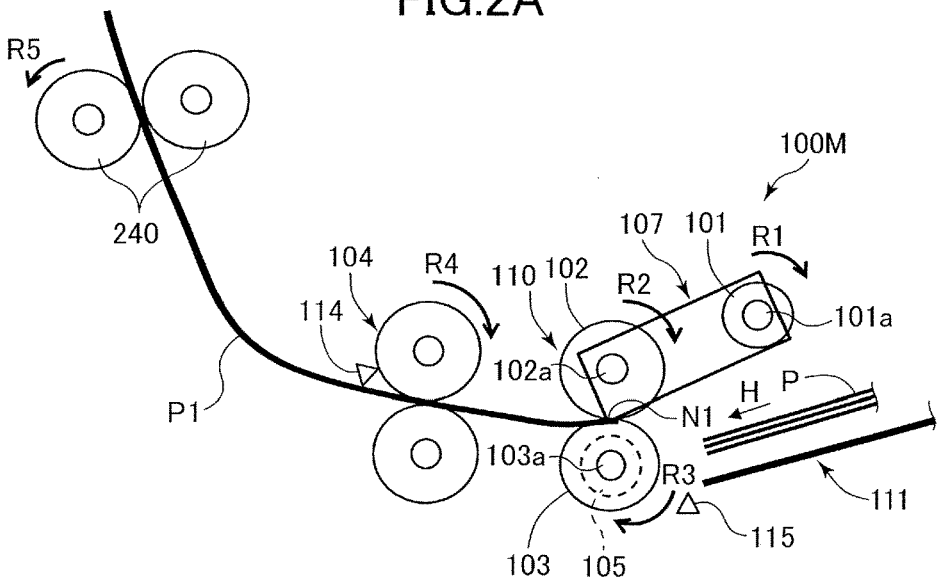
FIG. 2A is a section view schematically illustrating a sheet feeding route of a manual sheet feeding apparatus.
Figure 2B:
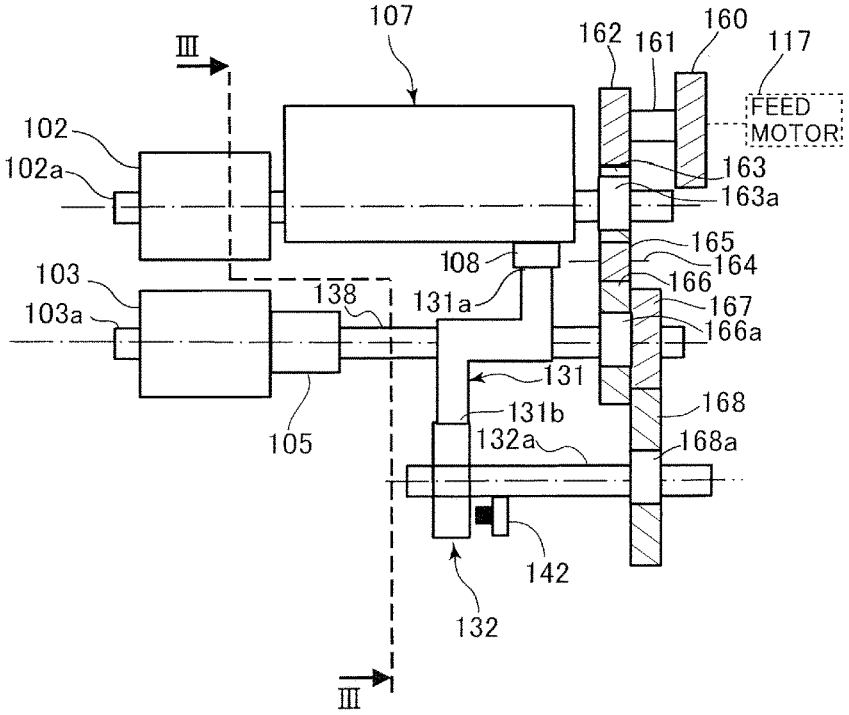
FIG. 2B is a section view schematically illustrating the manual sheet feeding apparatus cut along a longitudinal direction.
Figure 9:
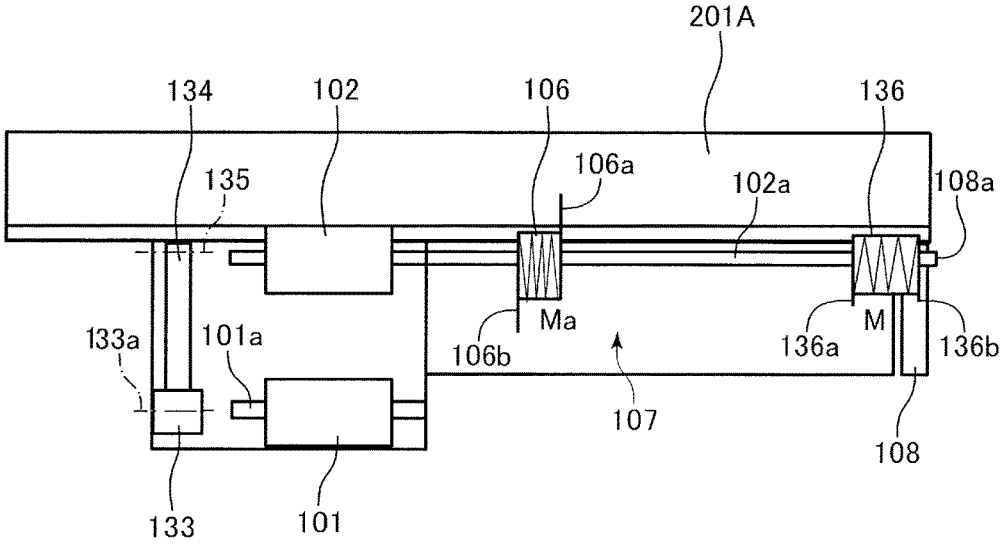
FIG. 9 is a diagram schematically illustrating major parts of the manual sheet feeding apparatus according to the first embodiment.
Figure 10:
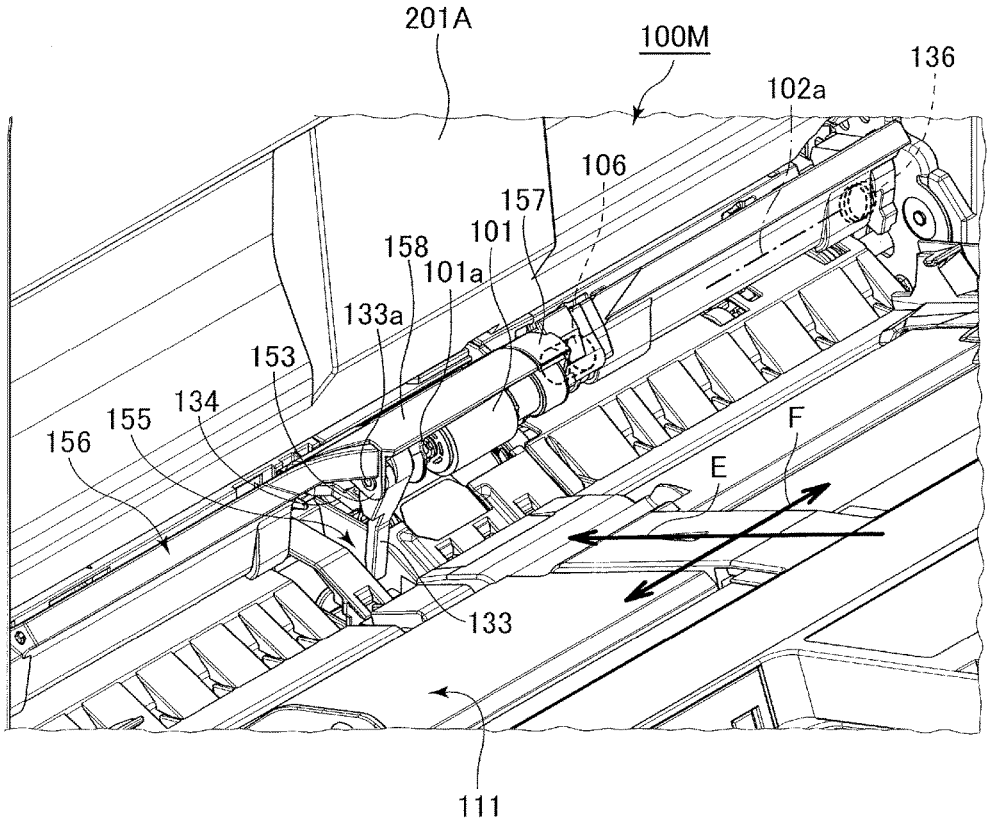
FIG. 10 is a perspective view illustrating a manual feed tray and the peripheral area thereof in detail.

Next, configuration of the manual sheet feeding apparatus 100M, i.e., the sheet feeding apparatus according to this embodiment, will be described in detail with reference to FIGS. 1, 2A, 2B, 9, and 10. Although the present and subsequent embodiments will be described as the manual sheet feeding apparatus 100M as an examples of the sheet feeding apparatus the sheet feeding apparatus is not limited to the manual sheet feeding apparatus 100M. FIG. 2A is a section view schematically illustrating a sheet feeding route of the manual sheet feeding apparatus 100M, and FIG. 2B is a section view schematically illustrating the manual sheet feeding apparatus in a longitudinal direction. FIG. 9 is a diagram schematically illustrating an overloaded state according to this embodiment. FIG. 10 is a perspective view illustrating a manual feed tray and the peripheral area thereof in detail.

As illustrated in FIGS. 2A, 2B, 9, and 10, the manual sheet feeding apparatus 100M is provided with a manual feed tray 111, i.e., a sheet supporting portion, of which the rotation base 111*b* is pivotally supported on a right side surface (see FIG. 1) of the apparatus body 201A. The manual feed tray 111 is configured to support a sheet P that is stacked to be fed in a manual feed. In addition, the feed holder 107 is disposed at a position facing the rotation base 111*b* (see FIG. 1) of the manual feed tray 111 in the apparatus body 201A. The feed holder 107 rotatably supports the pickup roller 101, i.e., a feed portion, which feeds the sheet P stacked on the manual feed tray and the conveyance roller 102, i.e., a conveyance portion. The conveyance roller 102 is disposed downstream of the pickup roller 101 in the sheet feeding direction (the direction of the arrow H), and is configured to rotate in the same direction and in synchronization with the pickup roller 101.

The retard roller 103, i.e. a separation portion, is supported rotatably about a retard roller shaft 103*a* supported by the apparatus body 201A, and is disposed below the conveyance roller 102. The pickup roller 101, the conveyance roller 102, and the retard roller 103 (FIG. 2A) are disposed at positions in substantially the middle portion in a width direction (a direction of an arrow F) perpendicular to the sheet feeding direction (a direction of an arrow E) of the manual feed tray 111 as illustrated in FIG. 10. The manual feed tray 111 is configured to be manually supplied a sheet to handle printing on an extra-large sheet, which excesses the maximum size to be contained in the sheet feeding cassettes 151 of the sheet feeding apparatuses 100A, 100B, 100C, and 100D, and a sheet of specific types, for example.

As illustrated in FIG. 10, a unit member 156 is mounted in the apparatus body 201A. A roller cover 158 is formed in the unit member 156 to cover the upper portion of the feed holder 107 which supports the pickup roller 101 and the conveyance roller 102. A roller retaining portion 157 is supported by the apparatus body. A pickup roller shaft 101*a* of the pickup roller 101 and a conveyance roller shaft 102*a* of the conveyance roller 102 are supported by the roller retaining portion 157. In this way, the pickup roller shaft 101*a* and the conveyance roller shaft 102*a* are supported by the apparatus body 201A through the roller retaining portion 157.

As illustrated in FIGS. 2A, 2B, and 10, the conveyance roller shaft 102*a* and the retard roller shaft 103*a* extend to the right direction in FIG. 10 from substantially the middle portion in the width direction (the direction of the arrow F) of the manual feed tray 111. As illustrated in FIGS. 2A and 2B, a feeding drive input gear 163 is attached to an end portion of the conveyance roller shaft 102*a* of the conveyance roller 102, which is rotatably supported by the feed holder 107 on the front side of the main body. In addition, a gear 166 is attached to an end portion of the retard roller shaft 103*a* of the retard roller 103, which is rotatably supported by the apparatus body 201A on the front side of the main body. On the back side of the apparatus body 201A is disposed a drive gear 160 which is rotated by receiving a drive force from a feed motor 117 (see also FIG. 11), i.e., a drive unit. It is noted that a leading-edge positioning member 133 and a lock member 134 are not illustrated in FIGS. 2A and 2B.

The drive gear 160 is attached to one end portion of a rotation shaft 161. A gear 162 is attached to the other end portion of the rotation shaft 161. The gear 162 is engaged with the feeding drive input gear 163. The feeding drive input gear 163 is engaged with the gear 166 through a gear 165 supported by a shaft 164. A gear 167 is coaxially fixed to the retard roller shaft 103*a* on which the gear 166 is supported. The gear 167 is engaged with a cam drive gear 168 attached to the end portion of a rotation shaft 132*a*, which pivotally supports a cam 132 with respect to the apparatus body 201A. It is noted that the retard roller shaft 103*a* may be the same member as a rotation shaft 138 to which a cam follower 131 is rotatably supported.

On the back side of the feed holder 107, an engagement member 108 (see FIG. 9) is pivotally supported by the end portion on the backward side of the feed holder 107 through a pivotal shaft 108*a*. The engagement member 108 is held in a state where the weight thereof is loaded on the cam 132 through the cam follower 131 (see FIGS. 7A and 7B). It is noted that, the conveyance roller shaft 102*a* and the retard roller shaft 103*a* in FIG. 2B are illustrated short compared to those in FIG. 10 for convenience sake. The pivot operation (elevating operation) of the feed holder 107 is interlocked with the operation of the feed motor 117. In addition, the retard roller 103, which normally abuts on the conveyance roller 102, is illustrated as being separated for convenience sake in FIG. 2B.

A first one-way clutch 163*a* is provided between the conveyance roller shaft 102*a* and the feeding drive input gear 163. In addition, a second one-way clutch 166*a* is provided between the retard roller shaft 103*a* and the separation drive input gear 166. A third one-way clutch 168*a* is provided between the rotation shaft 132*a* and the cam drive gear 168.

The first one-way clutch 163*a* transmits the rotation of the feeding drive input gear 163 caused by the forward rotation of the feed motor 117 to the conveyance roller shaft 102*a*. In addition, the first one-way clutch 163*a* does not transmit the rotation of the feeding drive input gear 163 caused by the reverse rotation of the feed motor 117 to the conveyance roller shaft 102*a*.

The second one-way clutch 166*a* transmits the rotation of the separation drive input gear 167 to the retard roller shaft 103*a* (the rotation shaft 138) when the feed motor 117 outputs the forward rotation. In addition, the second one-way clutch 166*a* does not transmit the rotation of the separation drive input gear 167 to the retard roller shaft 103*a* when the feed motor 117 outputs the reverse rotation.

The third one-way clutch 168*a* transmits the rotation of the cam drive gear 168 caused by the rotation of the feeding drive input gear 163, the gear 165, and the separation drive input gear 167 caused by the reverse rotation of the feed motor 117 to the rotation shaft 132*a*. In addition, the third one-way clutch 168*a* does not transmit the rotation of the cam drive gear 168 caused by the rotation of the separation drive input gear 167 to the rotation shaft 132*a* when the feed motor 117 outputs the reverse rotation.

The feed holder 107 is pivotally supported to pivot between a feeding position, i.e., an approach position, and a standby position, i.e., a separation position, about the conveyance roller shaft 102*a* as a pivot, while holding the pickup roller 101 and the leading-edge positioning member 133, i.e., a sheet regulation member. The feeding position is a position illustrated in FIG. 3B where the pickup roller 101 approaches the manual feed tray 111. The standby position is a position illustrated in FIG. 3A where the pickup roller 101 is separated from the manual feed tray 111 with respect to the standby position.

Since the one-way clutches 163*a*, 166*a*, and 168*a* are configured as described above, the conveyance roller shaft 102*a* and the retard roller shaft 103*a* are rotated through the operation of the first and second one-way clutches 163*a* and 166*a* when the feed motor 117 outputs the forward rotation. The pickup roller 101, the conveyance roller 102, and the retard roller 103 are thus rotated. In this case, since the cam drive gear 168 idles by the third one-way clutch 168*a*, the cam 132 is not rotated.

When the feed motor 117 outputs the reverse rotation, the feeding drive input gear 163, the gear 166, and the separation drive input gear 167 idle by the slipping of the first and second one-way clutches 163*a* and 166*a*. The pickup roller 101, the conveyance roller 102, and the retard roller 103 are thus not rotated. On the other hand, since the cam drive gear 168 is rotated through the third one-way clutch 168*a*, the cam 132 is rotated. The feed holder 107 is then elevated through the cam follower 131. In this way, the sheet feeding operation and the elevating operation of the pickup roller 101 in the present embodiment is separately performed by switching the forward/reverse rotation of the feed motor 117.

As illustrated in FIG. 9, a torsion coil spring 136 is provided in the vicinity of the engagement member 108 along the conveyance roller shaft 102*a*. The torsion coil spring 136 is provided, as illustrated in FIGS. 7 and 9, such that one end portion 136*a* is hooked to the feed holder 107 and the other end portion 136*b* is hooked to the engagement member 108, which is supported on the conveyance roller shaft 102*a* and the cylindrical pivotal shaft 108*a*. The engagement member 108 is hence biased in a direction of an arrow R7 illustrated in FIG. 3A, so as to protrude downward from the feed holder 107.

The torsion coil spring 136 constitutes a damper portion, or an external force absorbing portion, which absorbs external force (impact caused by butting of a sheet bundle, typically) applied from the vicinity of the manual feed tray 111 to the leading-edge positioning member 133 that is locked in a regulation posture (see FIG. 4A) by the lock member 134, i.e., a lock portion. In other words, the torsion coil spring, which is an example of a resilient member, is interposed between the engagement member 108 swung by a cam mechanism and the feed holder 107 provided separately from the engagement member, so that the external force applied to the leading-edge positioning member 133 is absorbed.

The torsion coil spring 136 is a torsion spring interposed between the apparatus body 201A supporting the conveyance roller shaft 102*a* and the feed holder 107 pivoting about the conveyance roller shaft 102*a* as a pivot. When an impact is applied to the leading-edge positioning member 133 in the regulation posture, the torsion coil spring 136 absorbs the impact through the rotational movement of the feed holder 107 about the conveyance roller shaft 102*a* as a pivot along with the rotation of the leading-edge positioning member 133 about an engagement position V (see FIG. 6) with the lock member 134 as a fulcrum.

In addition, as illustrated in FIG. 9, a pickup roller pressing spring 106 is fitted in the middle portion of the conveyance roller shaft 102*a* such that one end portion 106*a* is hooked to the apparatus body 201A and the other end portion 106*b* is hooked to the feed holder 107. The pickup roller pressing spring 106 is a biasing portion which biases the pickup roller 101 to pivot about the conveyance roller shaft 102*a* as a pivot in a direction toward the feeding position (approach position).

Figure 3A:
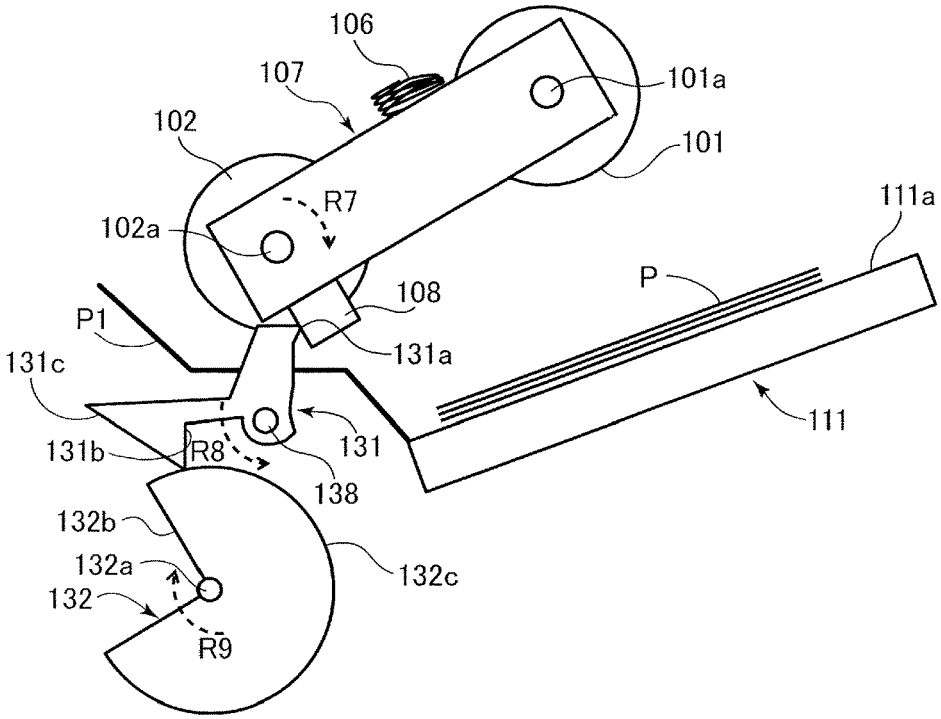
FIG. 3A is a diagram schematically illustrating the manual sheet feeding apparatus in a standby state when viewed in a direction taken along a line indicated with arrows in FIG. 2B.

As described above, the feed holder 107 is normally biased in the direction of the arrow R7 illustrated in FIG. 3A with respect to the apparatus body 201A. When the conveyance roller 102 is rotated in the direction of the arrow R7, the pickup roller 101 pivots in the same direction together with the feed holder 107. The pickup roller 101 comes into pressure contact (pressuring) with the sheet P on the manual feed tray 111. It is noted that while the pickup roller pressing spring 106 is illustrated as a torsion coil spring in FIG. 9, the pickup roller pressing spring may be the compression coil spring as illustrated in schematic diagram of FIGS. 3A and 3B as long as that spring has the same function.

The retard roller 103 is supported by a separation unit (not illustrated) biased upward by a spring (not illustrated), and comes into pressure contact with the conveyance roller 102 through the separation unit so as to generate a nip pressure in a separation nip portion N1. A torque limiter 105 (see FIG. 2B) is provided on the retard roller shaft 103*a* of the retard roller 103. When a load applied to the retard roller 103 through the sheet P from the conveyance roller 102 is equal to or more than a predetermined torque value (limit value) of the torque limiter 105, the retard roller 103 rotates (or driven to rotate) along with the sheet P. On the other hand, when a load applied to the retard roller 103 through the sheet P from the conveyance roller 102 is equal to or less than a predetermined torque, the retard roller 103 is reversely rotated (or stopped). The retard roller 103 is arranged in pressure contact with the conveyance roller 102 while leaving the sheet path therebetween, and configured to be rotated in the sheet feeding direction through the torque limiter 105. The drawing roller pair 104, disposed downstream of the separation conveyance portion 110 in the sheet feeding direction, draws the sheet P conveyed from the separation nip portion N1 and sends the sheet P to the registration roller pair 240.

Figure 3B:
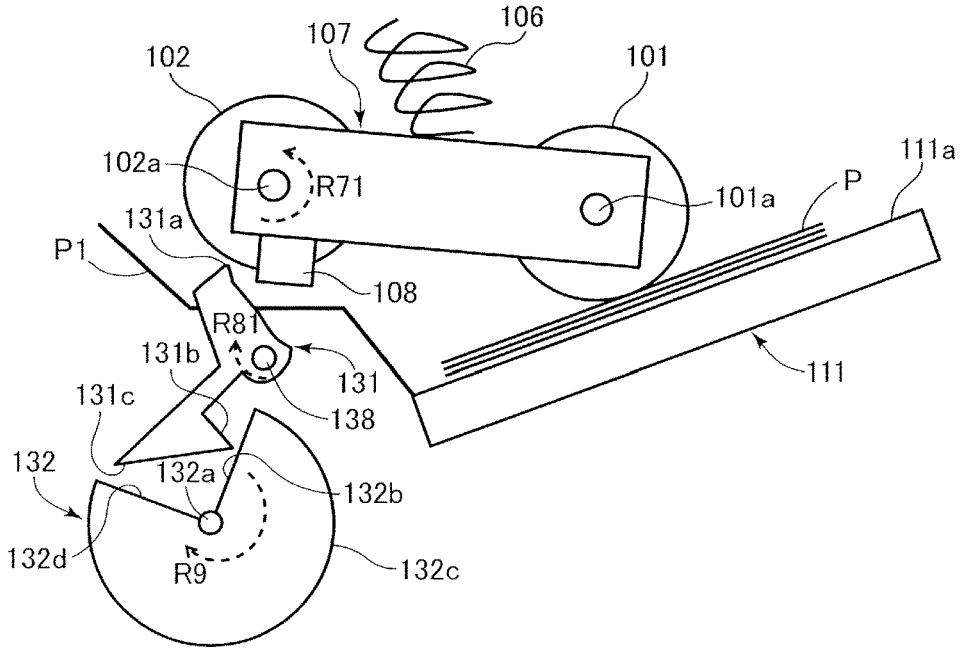
FIG. 3B is a diagram schematically illustrating the manual sheet feeding apparatus in a feeding state when viewed in a direction taken along the line indicated with arrows in FIG. 2B.
Figure 7A:
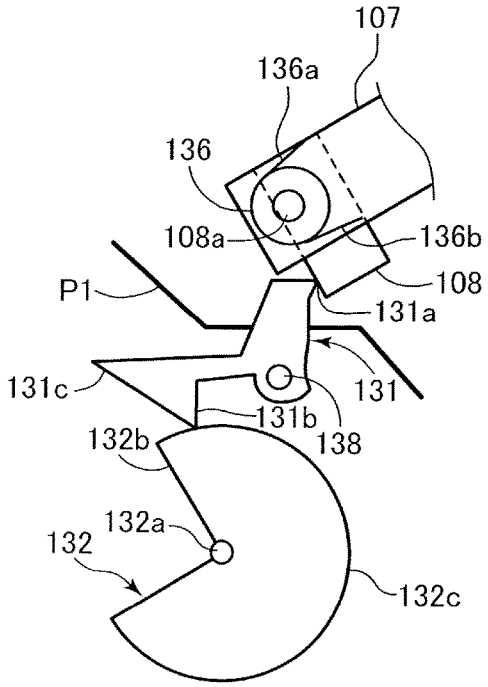
FIG. 7A is a diagram schematically illustrating a cam mechanism according to the first embodiment at a normal time.
Figure 7B:
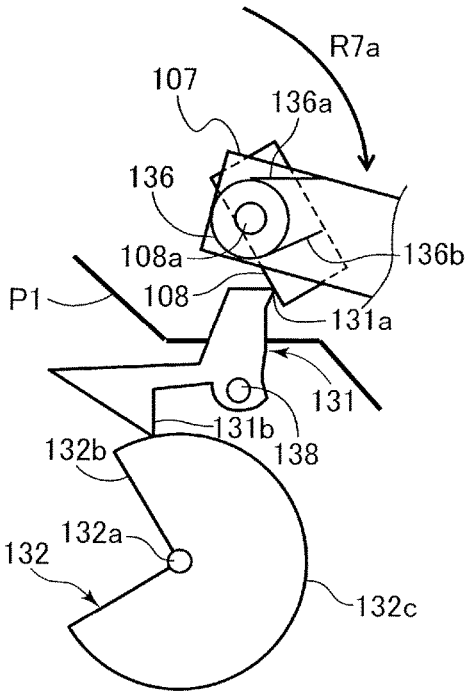
FIG. 7B is a diagram schematically illustrating the cam mechanism when overloaded.

Next, the cam follower 131 and the cam 132 illustrated in FIGS. 2B and 10, and the peripheral configuration thereof will be described with reference to FIGS. 2B, 3A, 3B, 7A, 7B, and 9. FIGS. 3A and 3B are section views cut along a line indicated with arrows in FIG. 2B, which schematically illustrate the cam follower and the cam. FIGS. 7A and 7B are diagrams schematically illustrating the cam follower 131, the cam 132, and the peripheral configurations in FIGS. 3A and 3B. FIG. 7A illustrates a normal state, and FIG. 7B illustrates an overloaded state.

As illustrated in FIGS. 2B, 3A, and 3B, the center portion of the cam follower 131 is rotatably fitted to the rotation shaft 138 extending in a front and back direction, with respect to the pages of those figures, of the apparatus body 201A. The cam follower 131 includes an engagement claw 131*a* having a shape engageable to the engagement member 108 protruding downward from the feed holder 107, and an engagement claw 131*b*. These claws are formed to protrude in the opposite direction to each other about the rotation shaft 138. In addition, the rotation shaft 132*a* is extended in a direction parallel to the rotation shaft 138. The cam 132 fixed in a state of passing through the rotation shaft 132*a* includes a guide surface 132*c* cut out by a quarter of its circumference and an engagement cut portion 132*b* which is cut out of the guide surface 132*c*. On a side of the apparatus body 201A, a cam H.P. (Home Position) photo sensor 142 is disposed at a position facing the cam 132 (see FIG. 2B).

In FIG. 3A, the elevating operation of the pickup roller 101 is interlocked with the elevating operation of the feed holder 107. The pickup roller pressing spring 106 consistently presses the pickup roller 101 to rotate in the direction of the arrow R7 about the conveyance roller shaft 102*a* as the pivot center (pivot). In other words, the cam 132 applies a load on the engagement member 108 of the feed holder 107 through the cam follower 131.

The feed holder 107 in a state of FIG. 3A is rotated in the direction of the arrow R7 about the conveyance roller shaft 102*a*. The cam follower 131 is supported rotatably about the rotation shaft 138 by its own weight. Therefore, the cam follower 131 receives a pressed force by the rotation shaft 138 and a rotational force by its own weight, and is biased in a direction of an arrow R8. In this state, when the cam 132 is rotated in a direction of an arrow R9, the cam follower 131 causes the engagement claw 131*b* to fall into the engagement cut portion 132*b* following the rotation of the cam, and thus the cam follower 131 is rotated in the direction of the arrow R8. Therefore, the feed holder 107 is rotated in the direction of the arrow R7. As a result, the pickup roller 101 falls down as illustrated in FIG. 3B.

On the other hand, in a lifting operation of the pickup roller 101, the cam 132 is rotated in the direction of the arrow R9 from the state of FIG. 3B. The cam follower 131 of which the engagement claw 131*b* falls into the engagement cut portion 132*b* pushes up a guide surface 131*c* while coming into sliding contact therewith by a projecting portion 132*d* of the engagement cut portion 132*b*. The cam follower 131 is rotated in a direction of an arrow R81, presses the engagement member 108 of the feed holder 107, and rotates the feed holder 107 in a direction of an arrow R71 about the conveyance roller shaft 102*a* of the conveyance roller 102. The pickup roller 101 is lifted up, and moves to the standby position as illustrated in FIG. 3A. At that time, the cam H.P. photo sensor 142 detects whether the pickup roller 101 is held at the standby position (FIG. 3A) or at the feeding position (FIG. 3B). It is noted that, the referential numeral "111*a*" indicates a stack surface of the manual feed tray 111.

Figure 4A:
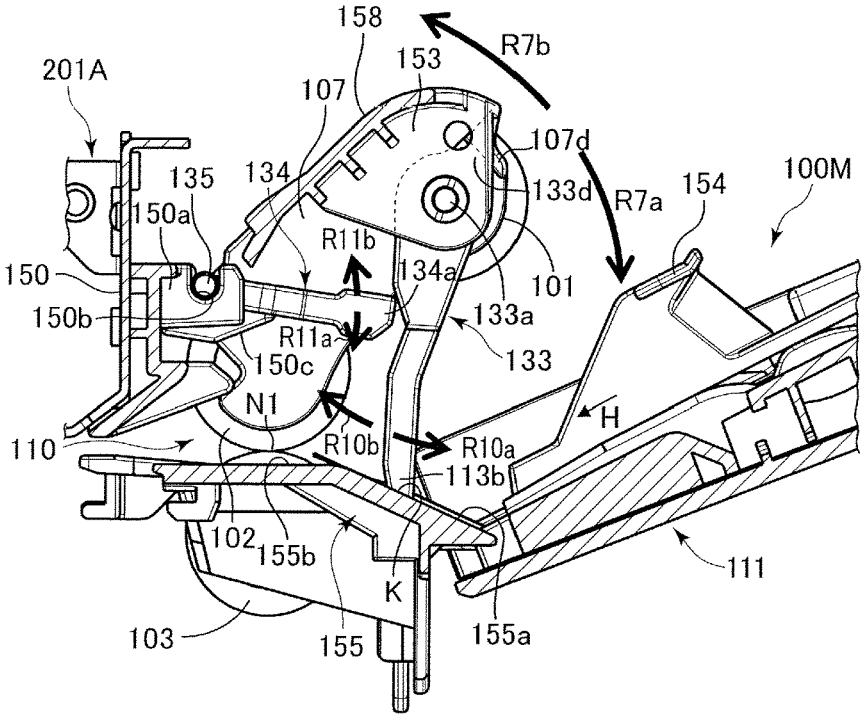
FIG. 4A is a section view illustrating the manual sheet feeding apparatus in the standby state.
Figure 4B:
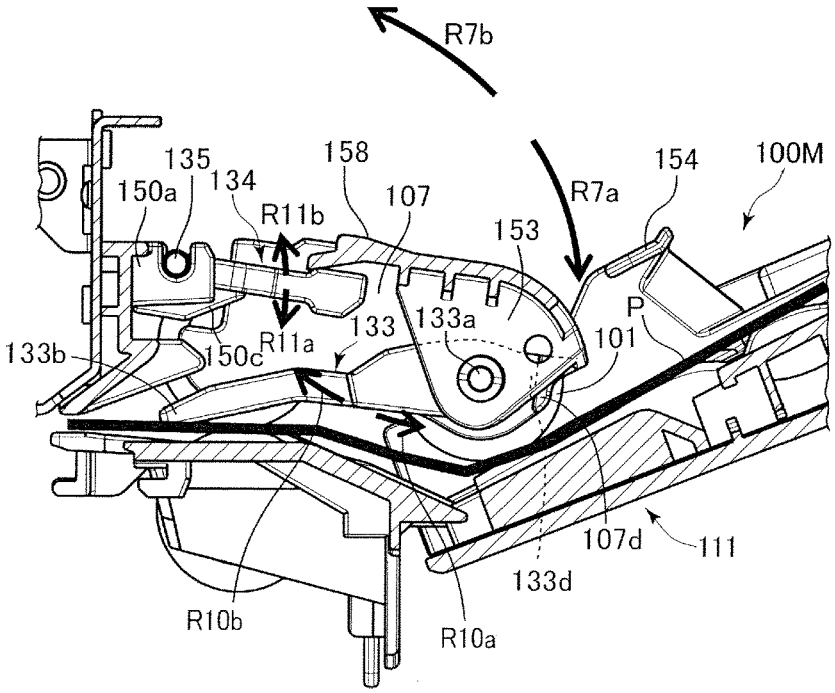
FIG. 4B is a section view illustrating the manual sheet feeding apparatus in the feeding state.
Figure 5:
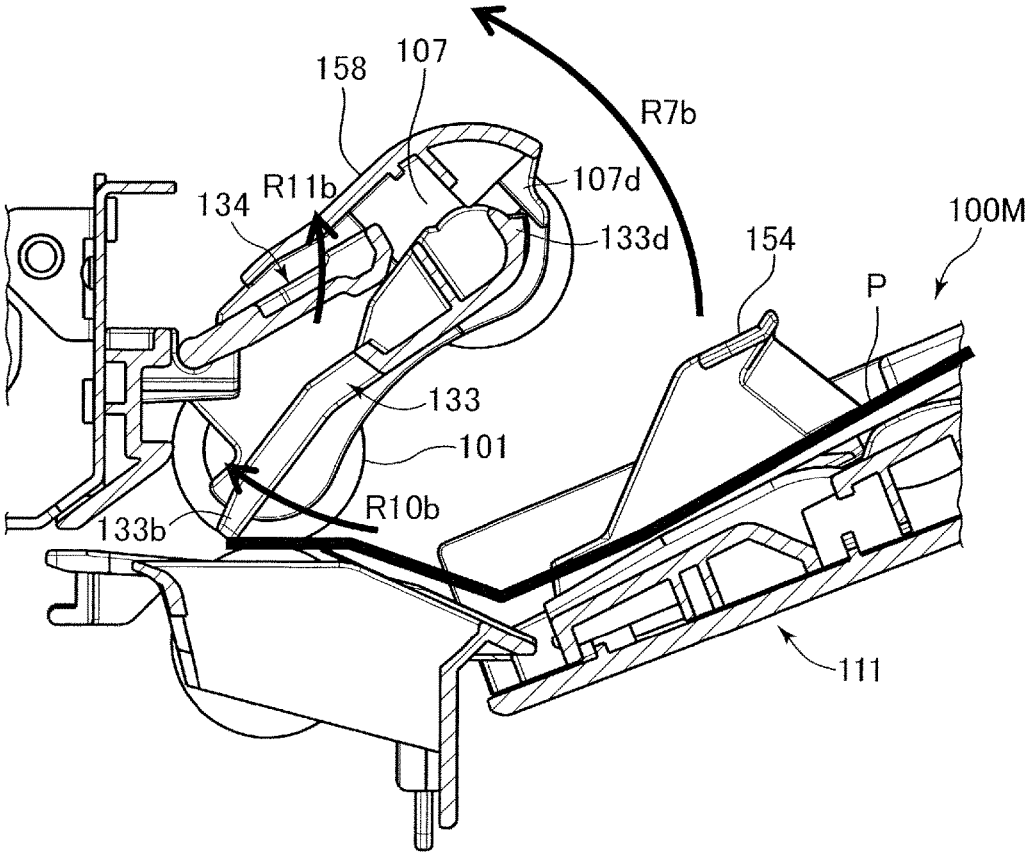
FIG. 5 is a section view illustrating the manual sheet feeding apparatus with a sheet left after a print job is ended.
Figure 6:
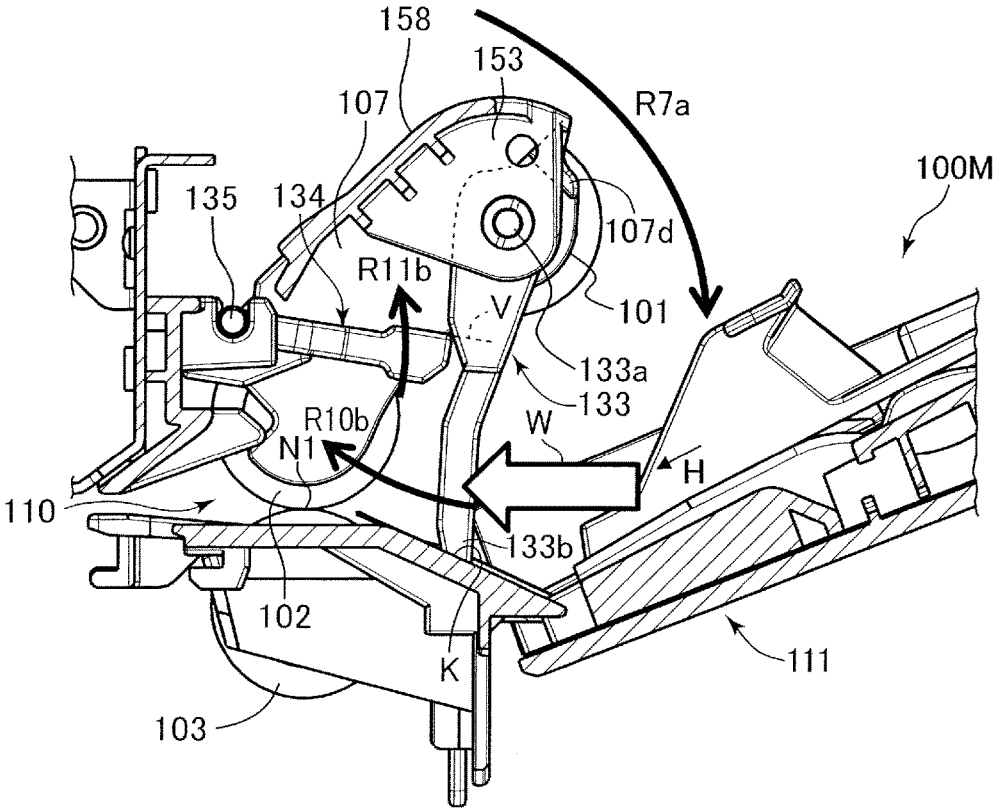
FIG. 6 is a section view illustrating the manual sheet feeding apparatus when an overload is applied to a leading-edge positioning member according to the first embodiment.

Next, a mechanism for positioning the end position using the leading-edge positioning member 133 and the lock member 134 will be described with reference to FIGS. 4A, and 4B to 6. It is noted that, FIG. 4A is a diagram schematically illustrating a state when the leading-edge positioning member is locked at the standby position. FIG. 4B is a diagram schematically illustrating a state when the leading-edge positioning member is released at the feeding position. FIG. 5 is a diagram schematically illustrating a state of the standby position in which a sheet is left after a print job is ended. FIG. 6 is a diagram schematically illustrating a state at the time of overload.

The leading-edge positioning member 133 held by the feed holder 107 is configured to pivot in directions of arrows R7*a* and R7*b* in the drawing with respect to a supporting portion 153 which is provided below the roller cover 158 in the unit member 156 (FIG. 10) through a pivotal shaft 133*a*. The pivotal shaft 133*a* of the leading-edge positioning member 133 is disposed in parallel with the pickup roller shaft 101*a* of the pickup roller 101 as illustrated in FIG. 9. The leading-edge positioning member 133 is pivotally supported with respect to the pickup roller 101 by the pivotal shaft 133*a* which is provided coaxially to the pickup roller shaft 101*a* of the pickup roller 101 in the feed holder 107.

The lock member 134 is disposed to face the leading-edge positioning member 133 that is erected as illustrated in FIG. 4A, and pivotable about a pivotal shaft 135 as a pivot. The pivotal shaft 135 is supported by a concaved portion 150*b* of a protruding portion 150*a* of a supporting portion 150, which is supported by the apparatus body 201A. The lock member 134 is supported to be swingable about the pivotal shaft 135 as a pivot in directions of arrows R11*a* and R11*b* in the drawing. Then, a lower limit position in a swing operation of the lock member 134 is determined by a stopper 150*c* which is extended from the lower portion of the protruding portion 150*a* toward the leading-edge positioning member 133.

The leading-edge positioning member 133 is disposed upstream of the separation nip portion N1 in the sheet feeding direction (a direction of an arrow H). The leading-edge positioning member 133 is configured to be displaceable between the regulation posture of FIG. 4A in which the leading edge of the sheet P stacked on the manual feed tray 111 is regulated not to enter the separation nip portion N1 and a retracted posture of FIG. 4B in which the sheet P passes through the separation nip portion N1. In addition, the lock member 134 functions to lock the leading-edge positioning member 133 to the regulation posture (FIG. 4A).

The leading-edge positioning member 133 is supported by the feed holder 107 to be rotated by its own weight so as to take the regulation posture when the feed holder 107 is rotated from the feeding position (approaching position) to the standby position (separated position). Then, the lock member 134 is engaged on the downstream part, in the sheet feeding direction, of the leading-edge positioning member 133 rotated to the regulation posture, and thus locked to the regulation posture.

On the apparatus body 201A, a guide portion 155 is disposed at a position below the leading-edge positioning member 133 and the lock member 134. In the guide portion 155, there are formed an inclined guide surface 155*a* which is inclined upward toward the downstream side in the sheet feeding direction (the direction of the arrow H), and a flat guide surface 155*b* which is horizontally extended further toward the downstream side from the inclined guide surface 155*a*.

In addition, inside the supporting portion 153 in the feed holder 107, there is formed an engagement projecting portion 107*d* which disposed to face to and engage with an upper projecting portion 133*d* of the leading-edge positioning member 133 supported by the pivotal shaft 133*a*. The leading-edge positioning member 133 pivots by its own weight such that a distal end portion 133*b* is headed downward without engaging the upper projecting portion 133*d* with the engagement projecting portion 107*d*, and thus moves to the regulation posture of FIG. 4A. When moving from the regulation posture to the retracted posture illustrated in FIG. 4B, the leading-edge positioning member 133 pivots integrally with the feed holder 107 like that the upper projecting portion 133*d* is scooped up by the engagement projecting portion 107*d* pivoting together with the feed holder 107 (see FIG. 5). The inclined guide surface 155*a* comes into sliding contact with the distal end portion 133*b* of the leading-edge positioning member 133 when moving from the regulation posture to the retracted posture. In addition, the inclined guide surface 155*a* abuts on the distal end portion 133*b* of the leading-edge positioning member 133 when moving from the retracted posture to the regulation posture.

Control System

Next, a control system of the manual sheet feeding apparatus 100M as the sheet feeding apparatus according to this embodiment will be described with reference to FIG. 11. It is noted that, FIG. 11 is a block diagram illustrating the control system.

Figure 11:
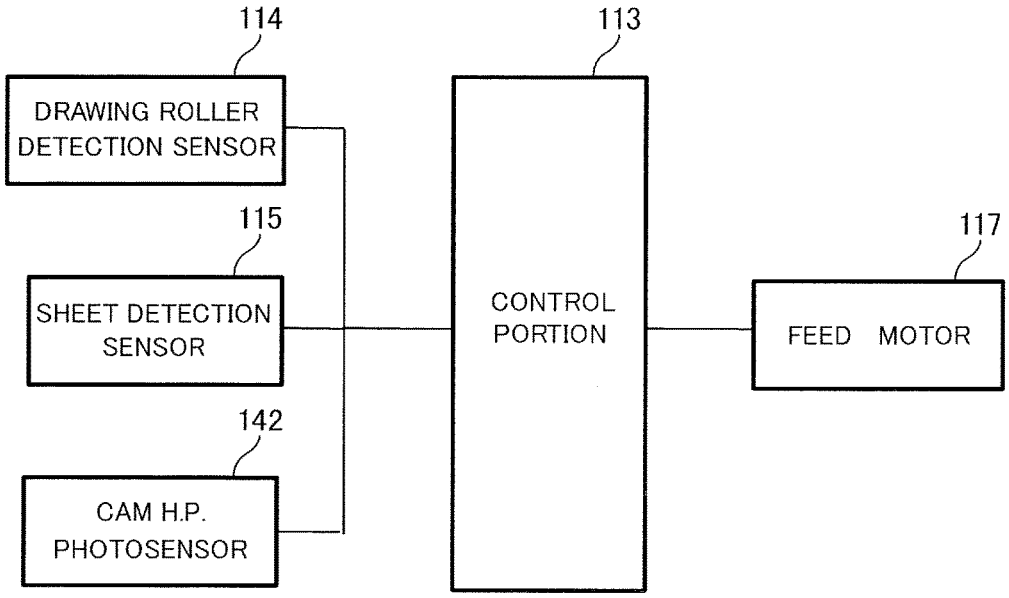
FIG. 11 is a block diagram illustrating a control system according to the first embodiment.

As illustrated in FIG. 11, the apparatus body 201A is provided with a control portion 113 which includes a central processing unit (CPU), a random access memory (RAM), and a read-only memory (ROM). A drawing roller detection sensor 114, a sheet detection sensor 115, and the cam H.P. photo sensor 142 are connected to the input ports of the control portion 113. In addition, the feed motor 117 is connected to the output port of the control portion 67.

The drawing roller detection sensor 114 is disposed downstream of the drawing roller pair 104 (see FIG. 2A), detects that the sheet P is nipped in the drawing roller pair 104, and outputs the signal to the control portion 113. The sheet detection sensor 115 is disposed downstream of the manual feed tray 111 in the sheet feeding direction (the direction of the arrow H), detects the presence/absence of the sheet P on the manual feed tray 111, and outputs the signal to the control portion 113. The cam H.P. photo sensor 142 is disposed at a position facing the cam 132, detects the position of the engagement cut portion 132*b* of the cam 132, and outputs the signal to the control portion 113 (see FIG. 2B).

The drawing roller detection sensor 114 and the sheet detection sensor 115 are configured by a photo-interrupter. That is to say, the drawing roller detection sensor 114 detects whether the sheet P is pulled out by the drawing roller pair 104 through positions of light-blocking plates (not illustrated) which are arranged to go in and out between a light-emitting unit and a light-receiving unit (not illustrated). In addition, the sheet detection sensor 115 detects whether there is the sheet P on a stack surface 111*a* of the manual feed tray 111. That is, when the light-blocking plate goes out with respect to the drawing roller detection sensor 114 or the sheet detection sensor 115, the light-blocking plate blocks a light path between the light-emitting unit and the light-receiving unit of the photo-interrupter. Then, the output signal of the light-receiving unit falls down to a Low level. On the other hand, when the light path is not blocked, the output signal rises to a High level. Therefore, it is possible to detect whether the sheet P is pulled out or whether there is the sheet P on the stack surface 111*a* with reference to the position where the output signal of the light-receiving unit is changed.

Operation in Sheet Feeding and Control

Next, the operation in a sheet feeding and the control thereof will be described with reference to FIGS. 2A, 2B, 3A, 3B, and 11.

First, in FIG. 3A, the pickup roller 101 is on standby at the standby position above the stack surface 111*a* of the manual feed tray 111. Thereafter, when the feed motor 117 is reversely rotated by the control of the control portion 113, the cam 132 is rotated in the direction of the arrow R9 illustrated in FIG. 3A by a predetermined amount on the basis of the detection of the cam H.P. photo sensor 142, and goes to the feeding position illustrated in FIG. 3B.

When the feed motor 117 is forwardly rotated at the feeding position by the control of the control portion 113, the pickup roller 101, the conveyance roller 102, and the retard roller 103 are rotated respectively. Then, the sheet on the manual feed tray is fed one by one by the pickup roller 101. It is noted that, a time to forwardly rotate the feed motor 117 is set for each sheet on the basis of the detection of the drawing roller detection sensor 114 which is disposed downstream of the drawing roller pair 104.

Then, when the feed motor 117 is reversely rotated by the control of the control portion 113 after the inputted print job is ended, the cam 132 is rotated in the direction of the arrow R9 illustrated in FIG. 3B. The guide surface 131*c* of the cam follower 131 is pushed up by the projecting portion 132*d* while coming into sliding contact therebetween. When the cam follower 131 is rotated in the direction of the arrow R81, the engagement member 108 of the feed holder 107 is pressed by the engagement claw 131*a*, and the feed holder 107 is rotated in the direction of the arrow R71 about the conveyance roller shaft 102*a*. The pickup roller 101 is lifted up, and returns to the standby position of FIG. 3A. Through such a series of operations, the feeding operation of the manual sheet feeding apparatus 100M is performed.

In a case where the sheets are continuously fed, an all-sheet conveyance portion calculates and determines a sheet interval (an interval between sheets conveyed continuously) at which the trailing edge of the preceding sheet can be detected. Therefore, the feed motor 117 is repeatedly turned on and off to control the rotations of the pickup roller 101, the conveyance roller 102, and the retard roller 103.

In addition, in this embodiment, the elevating operation of the pickup roller 101 is not performed at the time of continuously passing the sheets (the sheets are continuously fed), and the pickup roller 101 is lifted up after the print job is ended. Therefore, it is possible to improve productivity of the manual sheet feeding apparatus 100M by reducing the sheet interval as narrow as possible.

Operation of Positioning Leading Edge of Sheet

Next, the operation of positioning of the leading edge of the sheet P stacked on the manual feed tray 111 will be described with reference to FIGS. 4A, and 4B to 8.

At the standby position illustrated in FIG. 4A, the leading-edge positioning member 133 is drawn down in the downward direction about the pivotal shaft 133*a* as a pivot by its own weight. The lock member 134 is also rotated downward by its own weight, and the lower limit position is determined by the stopper 150*c*. Therefore, at the standby position, the position of the width direction is determined in the sheet feeding direction (the direction of the arrow H), and the leading-edge positioning member 133 and the lock member 134 facing each other take the posture illustrated in FIG. 4A.

At the standby position, the leading edge of the sheet P stacked on the manual feed tray 111 abuts against the leading-edge positioning member 133. Upon abutting against the leading-edge positioning member 133, the abutting force of the sheet P generates a force to rotate the leading-edge positioning member 133 in a clockwise direction (a direction of an arrow R10*b*) in the drawing. However, this force is blocked by the lock member 134 through the leading-edge positioning member 133. Thus, when the sheet P abuts on the leading-edge positioning member 133, the leading-edge positioning member 133 retains the posture illustrated in FIG. 4A. Therefore, the regulation of the leading edge of the sheet P is performed by the leading-edge positioning member 133 and the lock member 134.

Then, the state is changed from the standby position illustrated in FIG. 4A to the feeding position as illustrated in FIG. 4B. That is, when the feed holder 107 falls down by the rotation of the feed motor 117 driven by the control of the control portion 113, the pickup roller 101 and the leading-edge positioning member 133 held by the feed holder 107 also are rotated and fall down together. In this case, a force to return to the reverse direction about the pivotal shaft 133*a* is applied to the leading-edge positioning member 133 by its own weight. However, since this force is not regulated only by the own weight of the member, the leading-edge positioning member 133 is easily rotated by a small force.

Thereafter, when the sheet is fed to the downstream in the sheet feeding direction (the direction of the arrow H) by the rotation of the pickup roller 101, the leading edge of the sheet P abuts against the leading-edge positioning member 133. The sheet P is fed while the leading-edge positioning member 133 is rotated in the clockwise direction (the direction of the arrow R10*b*). In this case, such resistance that may be a hindrance in feeding the sheet P is minimized, and it is possible to establish a stable feeding state.

State Transition from Feeding Operation Position to Feeding Standby Position

Next, a state transition from the feeding position to the standby position will be described. When the feeding operation at the feeding position is ended, the pickup roller 101 is lifted up by the feed motor 117 driven by the control of the control portion 113 together with the feed holder 107 which is rotated in a direction of an arrow R7*b* of FIG. 4B. Therefore, the pickup roller 101 and the leading-edge positioning member 133 held by the feed holder 107 are also lifted up.

At that time, in a case where there is no sheet on the manual feed tray, or in a case where the leading edge of the sheet is on the upstream side in the sheet feeding direction from the abutment portion of the leading-edge positioning member 133 (a portion denoted by K in FIG. 4A) and does not hinder in the way, the following process is performed. In other words, the leading-edge positioning member 133 and the lock member 134 are rotated by their own weight, and return to the standby position of the initial state (FIG. 4A).

On the other hand, in a case where the leading edge of the sheet left on the manual feed tray is left on the downstream side in the sheet feeding direction from the abutment portion (the portion denoted by "K" in FIG. 4A) of the leading-edge positioning member 133 (for example, a case where the leading edge is left within the separation nip portion N1), the sheet hinders the swing of the leading-edge positioning member 133. Therefore, the leading-edge positioning member 133 does not return to the initial position, and the swing of the lock member 134 is also hindered. In a case where the state is transitioned in this state from the feeding position to the standby position, the distal end portion 133*b* of the leading-edge positioning member 133 is kept in a state as illustrated in FIG. 5 by the leading edge of the sheet. Then, the lock member 134 swings as the pivotal center of the leading-edge positioning member 133 is lifted up, and returns to the initial position.

In this way, the lock member 134 is configured to be swingable, so that the leading-edge positioning member 133 moves to the standby position without giving stress to the leading edge of the sheet P. When the sheet P is removed from the manual feed tray 111 in this state, the leading-edge positioning member 133 and the lock member 134 are swung by their own weight and return to the initial state (FIG. 4A) as described with reference to FIG. 5.

Prevention of Overload Caused by Abutment

Next, configuration for preventing overload caused by the abutment will be described. In this embodiment, it is paid attention to a time when the sheet is set in the manual sheet feeding apparatus 100M provided with the pickup roller 101, the leading-edge positioning member 133, and the control portion 113. As already described above, the torsion coil spring 136 is interposed in the end portion of the feed holder 107 to which the leading-edge positioning member 133 is attached so as to absorb the force loaded on the leading-edge positioning member 133 by the elastic deformation of the torsion coil spring 136.

In general, at the standby position of the feed holder 107, the leading-edge positioning member 133 for setting the sheet on the manual feed tray 111 is locked. This lock is designed to prevent the sheet P from a separation failure even when, in setting operation, the sheets are forced into the separation nip portion N1 as a bundle. At that time, it might happens that an overload caused by the abutment of the sheets when the user sets the sheets, or disturbance beyond expectation are applied to the apparatus. Taking such situations into consideration, there is a concern that the components may be damaged or the sheet is folded at the setting time.

In the present embodiment, the leading-edge positioning member 133 abuts on the lock member 134 to be locked in normal cases. On the contrary, when there occurs an overload state in which an overload (excessive load) equal to or more than a predetermined amount is applied, as illustrated in FIGS. 6, 7A, and 7B, the feed holder 107 is rotated in a direction of an arrow R7*a* by an instantaneous load applied on the conveyance roller shaft 102*a* through the leading-edge positioning member 133. Thus that force is absorbed by the deformation of the torsion coil spring 136 (see FIGS. 7, 9, and 10) which is arranged at in the rotation base (root). As described above with reference to FIGS. 7A and 7B, the pivot base of the feed holder 107 is held at the standby position by the abutment between the cam follower 131 and the cam 132. Therefore, the instantaneous rotational load in the direction of the arrow R7*a* of the feed holder 107 can be absorbed by the torsion coil spring 136 which is interposed between the feed holder 107 and the engagement member 108. The feed holder 107 relatively moves with respect to the engagement member 108, and the leading-edge positioning member 133 is displaced as the feed holder 107 moves.

In other words, when the overload in a direction of an arrow W of FIG. 6 acts on the leading-edge positioning member 133 at the standby position illustrated in FIG. 7A, the leading-edge positioning member 133 is biased to rotate in a direction of an arrow R10*b*, but the force is suppressed by the support of the lock member 134. Here, the distal end portion (that is, a contact portion) of the lock member 134 as illustrated in FIG. 6 abuts on the engagement position V between the pivotal shaft 133*a* and the distal end portion with respect to the pivotal shaft 133*a* in the surface on the opposite side to a regulating surface on which the sheet abuts in the leading-edge positioning member 133. Thus, the feed holder 107 pivots in the direction of the arrow R7*a* of FIG. 7B about the engagement position V as a fulcrum. Therefore, when the leading-edge positioning member 133 reaches a predetermined releasing position (a shutter releasing position) on the downstream side from the abutment portion (portion K of FIG. 4A), a shutter function of the leading-edge positioning member 133 is released. In other words, the leading-edge positioning member 133 is configured to be changed from the regulation posture to the retracted posture when an external force of an amount equal to or more than an allowable range for being not absorbed by the elastic deformation of the torsion coil spring 136.

In this way, even in a case where the overload is applied on the leading-edge positioning member 133 in a state where the leading-edge positioning member 133 is locked by the lock member 134, the feed holder 107 is rotated, while the torsion coil spring 136 absorbing the load. Therefore, the shutter function of the leading-edge positioning member 133 is appropriately released without causing damage on the components. In addition, a force of the torsion coil spring 136 in the sheet passing state is an unloaded state with respect to the leading-edge positioning member 133 (see FIG. 4B). Therefore, it is possible to provide a stable feeding state without causing a feeding resistance.

In this embodiment, in a case where a load equal to or more than a predetermined amount (for example, a load equal to or more than 15 [N]) is applied to the positioning member 133, the lock is set to be released even at the standby position. This load is determined on an assumption that how much load is applied to the positioning member 133 when a bundle of thick sheets is set in a normal manner. In addition, a spring pressure of the torsion coil spring 136 is set to satisfy the following relation, so that the lock of the lock member 134 is released in a condition in which a load equal to or more than an allowable quantity (for example, 15 [N] or more) is applied.

Figure 8:
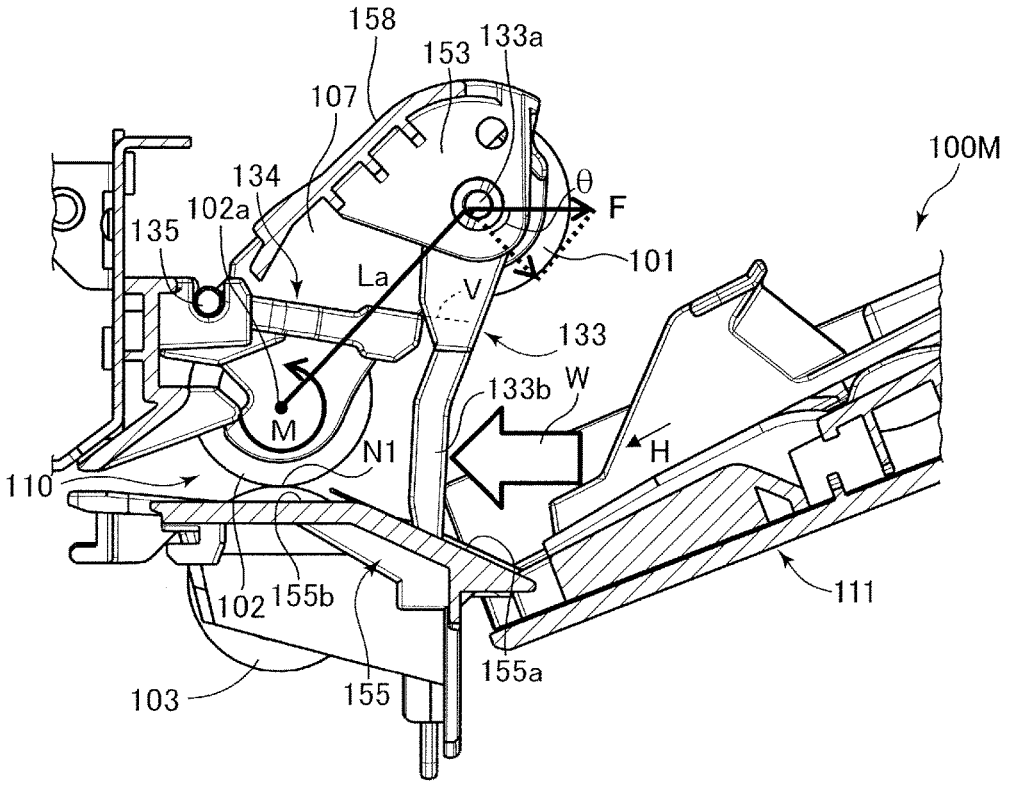
FIG. 8 is a diagram schematically illustrating major forces acting on the apparatus when the overload is applied to the leading-edge positioning member according to the first embodiment.

In this embodiment, the spring pressure of the torsion coil spring 136 is set to be optimized as described below (see FIGS. 8 and 9). It is assumed that a load F [N] is applied to the pivotal shaft 133*a* when the leading-edge positioning member 133 is in the regulation posture and the torsion coil spring 136 is twisted between the apparatus body 201A and the feed holder 107 under an impact applied to the leading-edge positioning member 133. A distance between the pickup roller 101 and each rotation shaft of the conveyance roller 102 is referred to as La [mm]. An angle formed between the direction of movement of the pickup roller shaft 101*a* when the feed holder 107 pivots and the direction of the load F is referred to as θ [degrees]. Furthermore, a moment of force of the torsion coil spring 136 and a safety factor are respectively referred to as M [N mm] and α. In this case, the parameters are set to satisfy a relation of the following equation.

$$M=F\cos\theta\times La\times\alpha \quad (1)$$

Furthermore, the parameters are set to satisfy a relation of the following equation, $$M>Ma \quad (2)$$

where Ma [N mm] refers to a moment of force of the pickup roller pressing spring 106. This relation means that the moment applied to the feed holder 107 when the torsion coil spring 136 starts to be elastically deformed is larger than the moment which is applied to the feed holder 107 by the pickup roller pressing spring 106.

As described above, with the settings to satisfy the equation (1), it is possible to set an optimized spring pressure (optimized pressure) of the torsion coil spring 136 attached to the conveyance roller shaft 102*a*, i.e., the rotation base of the feed holder 107. A biasing force of the pickup roller pressing spring 106 is applied to the feed holder 107. Herein, with the settings to satisfy the inequation (2), the feed holder 107 is appropriately retained at the standby position by the torsion coil spring 136 of the rotation base (root) when the feed holder 107 is lifted up to the standby position (FIG. 3A) while maintaining the pressure of the pickup roller 101. That is, when the feed holder 107 is lifted up through the cam follower 131 as illustrated in FIG. 3A, a moment M of the spring 136 overcomes a moment Ma of the pressing spring 106, so that the feed holder 107 is appropriately regulated and held at the standby position. On the other hand, when the feed holder 107 is released from the cam follower 131 as illustrated in FIG. 3B and the moment M is not applied to the feed holder 107 any more, the pickup roller 101 abuts on the sheet on the manual feed tray with an appropriate force by the moment Ma of the pressing spring 106.

According to the above-described embodiment, the leading edge of the sheet is appropriately regulated in setting of the sheet, and the overload is appropriately absorbed by the torsion coil spring 136 in a case where the overload is applied by a conflict of a sheet bundle. Therefore, it is possible to prevent inconvenience such that the leading-edge positioning member 133 is damaged or the leading edge of the sheet is buckled. In addition, the leading-edge positioning member 133 takes the retracted posture illustrated in FIG. 4B at the time of feeding the sheet, in which little weight is applied onto the sheet. Therefore, the feeding resistance against the sheet on the sheet feeding route is not increased.

In addition, in this embodiment, the torsion coil spring 136 is used as a damper portion which is interposed between the apparatus body 201A supporting the conveyance roller shaft 102*a* and the feed holder 107 pivoting about the conveyance roller shaft 102*a* as a pivot. With this configuration, in a case where an impact is applied to the leading-edge positioning member 133 in the regulation posture, the impact is absorbed through the feed holder 107 which rotates in conjunction with the rotation of the leading-edge positioning member 133. Therefore, the structure of absorbing the overload generated by the impact caused by a conflict of a sheet bundle is realized with a simple and inexpensive configuration.

Second Embodiment

Figure 12A:
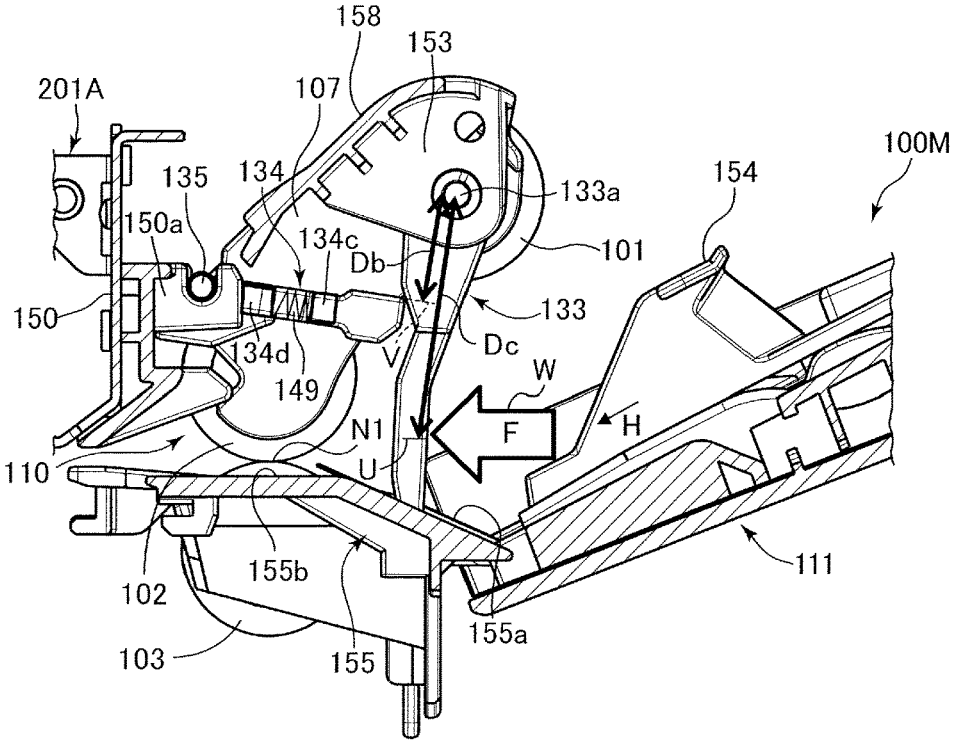
FIG. 12A is a section view illustrating a leading-edge positioning member according to a second embodiment of this disclosure.
Figure 12B:
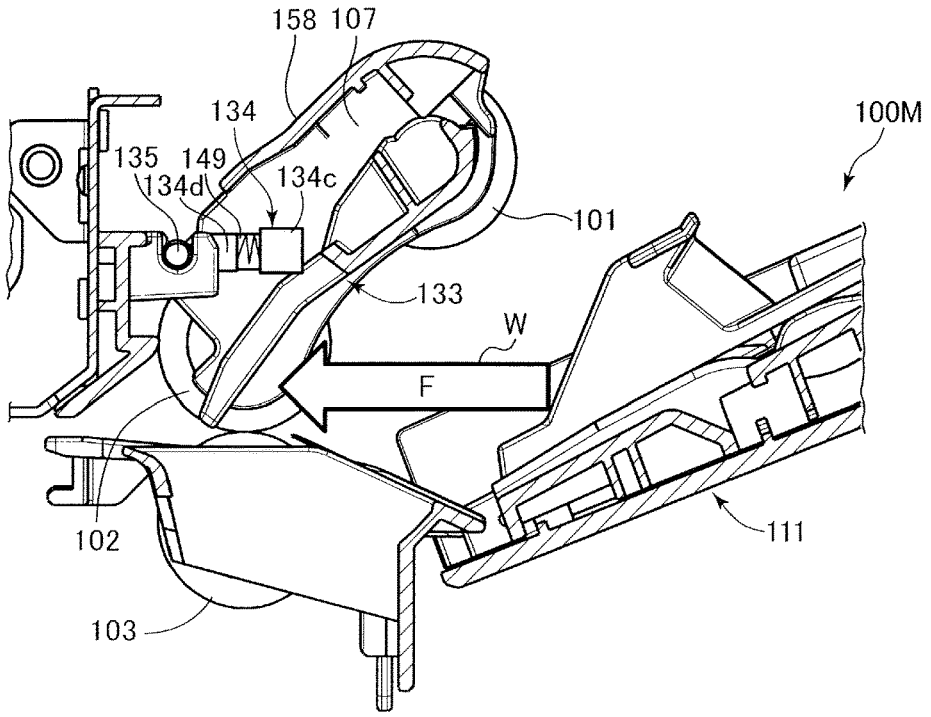
FIG. 12B is a section view illustrating the manual sheet feeding apparatus when overloaded.

Next, a second embodiment of this disclosure will be described with reference to FIGS. 12A and 12B. It is noted that, FIG. 12A is a diagram schematically illustrating a state where the leading-edge positioning member according to this embodiment is locked at the standby position. FIG. 12B is a diagram schematically illustrating an overloaded state. It is noted that in this embodiment, the same components as those of the first embodiment will be denoted with the same referential numerals, and the descriptions of the components having the same configurations and the same functions will be omitted.

In this embodiment, a compression spring 149 is interposed in the lock member 134. The lock member 134 is configured to be compressed so as to allow the leading-edge positioning member 133 to be displaced when overloaded, so that the overload is absorbed. That is, the lock member 134, i.e., a lock portion of this embodiment, includes an engagement portion 134*c* which is engaged with the leading-edge positioning member 133 in the regulation posture as illustrated in FIGS. 12A and 12B, and a retaining portion 134*d*, i.e., a held portion, which contains the pivotal shaft 135 supported by the apparatus body 201A. The engagement portion 134*c* and the retaining portion 134*d* are formed to make a space therebetween to provide the compression spring 149, i.e., a resilient member, in a compressed state. The engagement portion 134*c* is supported by the retaining portion 134*d* in a sliding manner. The compression spring 149 serves as a damper portion in this embodiment.

Then, the following relation is satisfied in order to set an optimal spring pressure of the compression spring 149 in this embodiment. That is, when the leading-edge positioning member 133 is in the regulation posture and the compression spring 149 is compressed between the engagement portion 134*c* and the retaining portion 134*d*, a load caused by an impact is referred to as F [N]. In addition, a distance between an overload point U where the impact is applied to the leading-edge positioning member 133 and the pivotal shaft (regulation pivotal shaft) 133*a* is referred to as Dc [mm]. A spring pressure of the compression spring 149 is referred to as Fb [N]. Furthermore, a distance between the engagement position V (an engagement position between the lock member 134 and the leading-edge positioning member 133) and the pivotal shaft 133*a* is referred to as Db [mm]. A safety factor is referred to as a. Then, those parameters are set such that the following relation is satisfied.

$$Fb<(F\times Dc)/Db\times\alpha \quad (3)$$

In this embodiment, it is possible to prevent that the components are damaged due to the overload, and that the leading edge of the sheet is buckled, if the above inequation (3) is satisfied. In addition, the leading edge of the sheet is appropriately regulated in setting of the sheet by the biasing force of the compression spring 149, which is interposed between the engagement portion 134*c* and the retaining portion 134*d*. On the other hand, when an excessive impact is applied to the leading-edge positioning member 133 in the regulation posture, the compression spring 149 is compressed. Thus, the engagement portion 134*c* pressed to the leading-edge positioning member 133 is allowed to be displaced, so that the impact is excellently absorbed. Still further, in this embodiment, the leading-edge positioning member 133 abuts on the lock member 134 in which the compression spring 149 is interposed. Thus, it is possible to effectively prevent the damage of the components as the lock member 134 directly receives the overload.

Third Embodiment

Figure 13A:
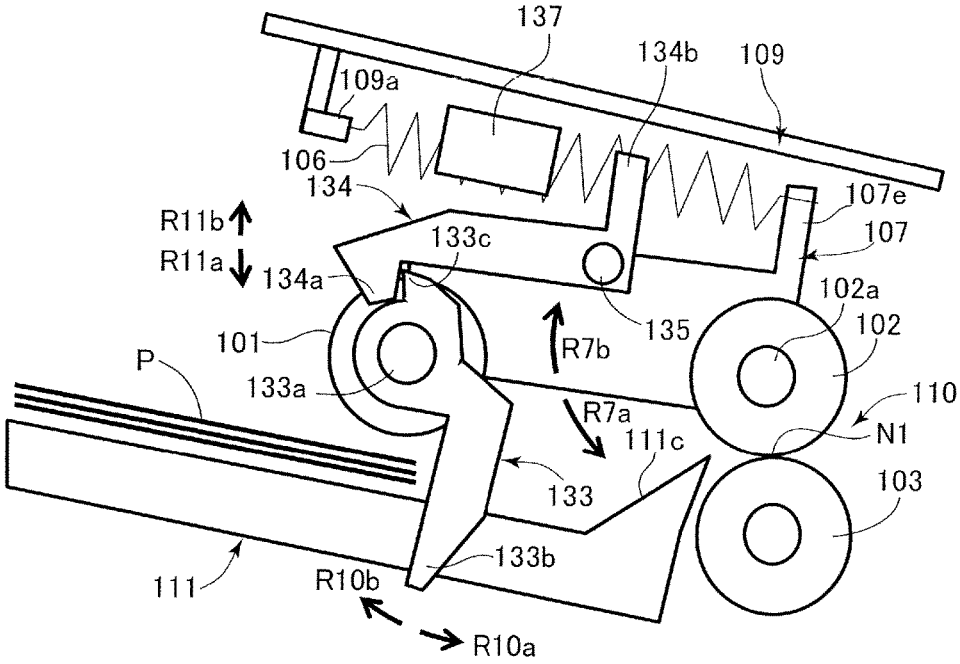
FIG. 13A is a diagram schematically illustrating a leading-edge positioning member according to a third embodiment of this disclosure.
Figure 13B:
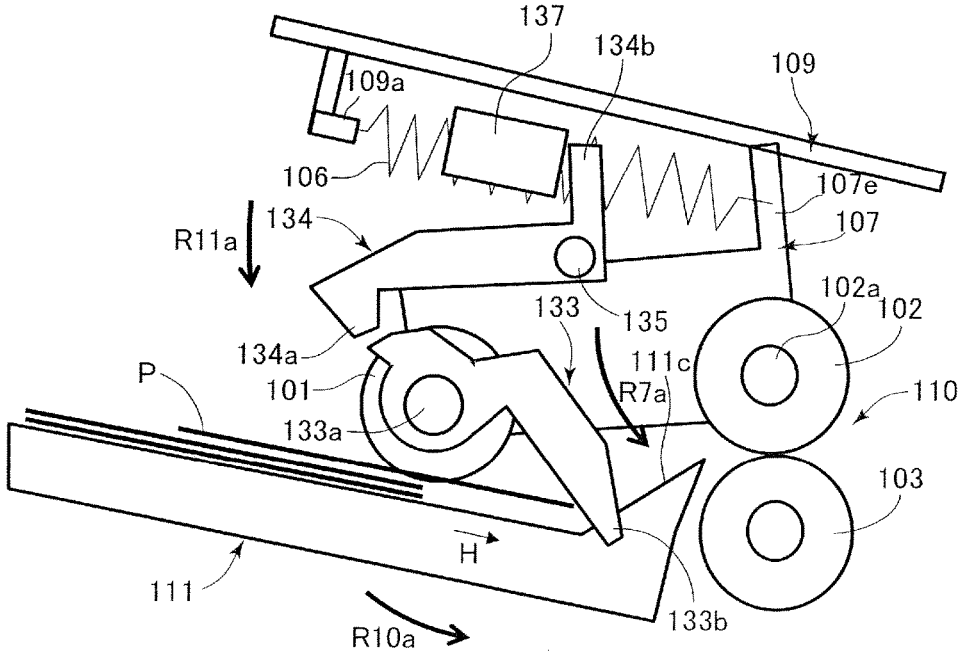
FIG. 13B is a diagram schematically illustrating the manual sheet feeding apparatus when the leading-edge positioning member takes a retracted posture.
Figure 14:
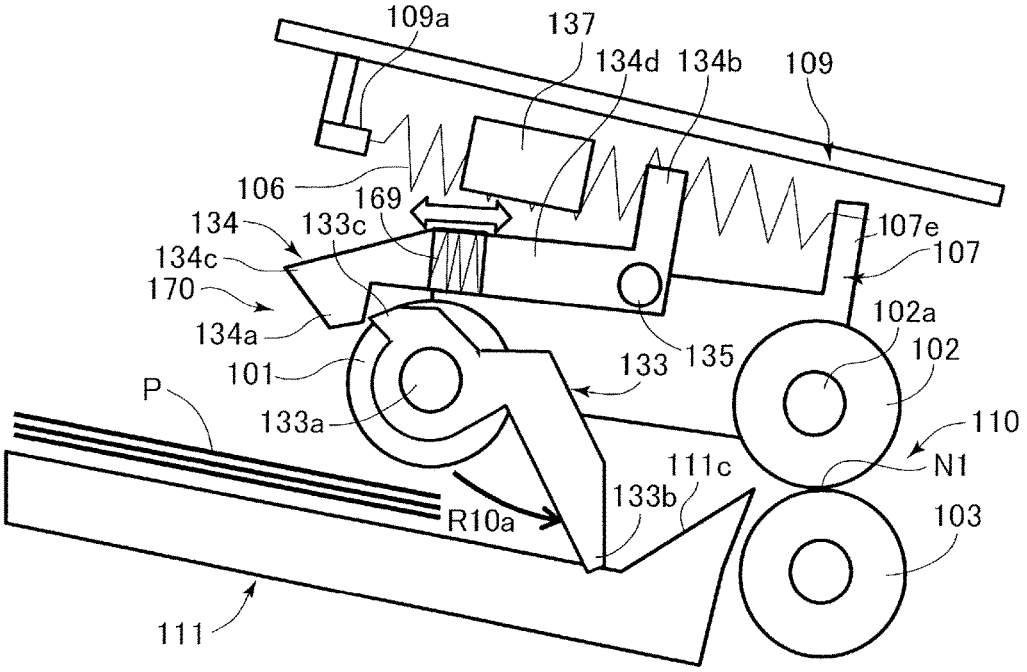
FIG. 14 is a diagram schematically illustrating the manual sheet feeding apparatus in a case where an overload is applied to the leading-edge positioning member according to the third embodiment.

Next, a third embodiment of this disclosure will be described with reference to FIGS. 13A, 13B, and 14. FIG. 13A is a diagram schematically illustrating a state when the leading-edge positioning member 133 according to this embodiment is locked at the standby position. FIG. 13B is a diagram schematically illustrating an overloaded state. FIG. 14 is a diagram schematically illustrating a state where the overload is applied to the leading-edge positioning member according to the third embodiment. It is noted that in this embodiment, the same components as those of the first embodiment will be denoted with the same referential numerals, and the descriptions of the components having the same configurations and the same functions will be omitted.

This disclosure is not limited to the configurations ("shutter" configurations) in the above-described first and second embodiments. Other configurations may be used to bias the spring so as to prevent the damage of the components in case of overloaded. In this third embodiment, another shutter configuration different from those used in the first and second embodiments will be described.

In this embodiment, as illustrated in FIG. 13A, there is provided a feeding frame 109 attached on a side of the apparatus body 201A above the manual feed tray 111. Then, the feed holder 107, the lock member 134, and the leading-edge positioning member 133 are disposed between the manual feed tray 111 and the feeding frame 109. There is provided a projecting portion 109*a* which protrudes downward upstream of the feeding frame 109 in the sheet feeding direction. In addition, the feed holder 107 pivotally supported about the conveyance roller shaft 102*a* as a pivot is provided with a projecting portion 107*e* which protrudes upward from the upper portion thereof in the downstream side in the sheet feeding direction. Both ends of the pickup roller pressing spring 106 made of a tension spring are locked between the projecting portion 109*a* and the projecting portion 107*e*. In addition, a guide portion 111*c* is provided at the front end portion of the manual feed tray 111 to guide the sheet P toward the separation nip portion N1 from the manual feed tray 111.

A stopper 137 is fixed to the feeding frame 109 to determine the lower limit of a pivot range of the lock member 134. The pickup roller 101 is held on the upstream side in the sheet feeding direction in the feed holder 107. The pivotal shaft 133*a* is provided coaxially to the pickup roller shaft 101*a* of the pickup roller 101. The leading-edge positioning member 133 is pivotally (swingably) supported by the pivotal shaft 133*a*. In the leading-edge positioning member 133, the distal end portion 133*b* is provided on the downstream side in the regulation posture of FIG. 13A. An upper end claw portion 133*c* is provided as a projecting portion in the upper portion of the leading-edge positioning member 133.

In the upper edge of the feed holder 107, one end portion of the lock member 134 (a lock portion) is pivotally (swingably) supported by the pivotal shaft 135. The pivotal shaft 135 is positioned in the middle of the conveyance roller 102 and the pickup roller 101. The lock member 134 includes an engagement claw portion 134*a* at a position to be engageable with the upper end claw portion 133*c* of the leading-edge positioning member 133. Further, the lock member 134 includes an engagement projecting portion 134*b* at a position to be engageable with the stopper 137.

The manual sheet feeding apparatus having the above configurations is held at the standby position illustrated in FIG. 13A by cogging torque when the feed motor 117 (see FIG. 11) is stopped. Then, the leading-edge positioning member 133 is drawn down by its own weight, and the lock member 134 is rotated downward by its own weight. Therefore, the engagement claw portion 134*a* is engaged with the upper end claw portion 133*c*. The leading-edge positioning member 133 takes the regulation posture.

In this state, when the sheet bundle (P) is stacked in the manual feed tray 111 and the leading edge of the sheet abuts on the leading-edge positioning member 133, the leading-edge positioning member 133 receives a rotation force to the counterclockwise direction of FIG. 13A by the abutment force. However, since the upper end claw portion 133*c* is engaged with the engagement claw portion 134*a*, the leading-edge positioning member 133 is suppressed in its rotation force and keeps the regulation posture, thereby the leading edge of the sheet being positioned.

Then, when the feed holder 107 moves to the feeding position from the standby position, the feed motor 117 is rotated by the control of the control portion 113, and the feed holder 107 is lifted down about the conveyance roller shaft 102*a* as a pivot. Therefore, the pickup roller 101 and the leading-edge positioning member 133 held by the feed holder 107 are lifted down while being rotated in the direction of the arrow R7*a*, and take the feeding position illustrated in FIG. 13B.

At that time, a returning force toward the opposite direction acts on the leading-edge positioning member 133 by the weight of the member about the pivotal shaft 133*a* as a pivot. However, since this force is not regulated only by the own weight of the member, the leading-edge positioning member 133 is easily rotated by a small force at the time of feeding the sheet P. In other words, the lock member 134, which is held by abutting on the stopper 137, is released from the stopper 137, so that the leading-edge positioning member 133 swings about the pivotal shaft 133*a* to the retracted posture as illustrated in FIG. 13B. Thereafter, when the sheet P is sent toward the downstream in the sheet feeding direction (the direction of the arrow H) by the rotation in the counterclockwise direction of the pickup roller 101, the sheet P is fed while the leading edge of the sheet abuts on the leading-edge positioning member 133 and the leading-edge positioning member 133 is reversely rotated in the counterclockwise direction. In other words, little feeding resistance against the sheet P acts during the feeding, and a stable feeding is performed.

Next, a state transition from the feeding position to the standby position will be described. That is, when the feeding operation is ended, the feed holder 107 is lifted up in the direction of the arrow R7*b* in FIG. 13A by the feed motor 117 which is driven by the control of the control portion 113. The pickup roller 101 and the leading-edge positioning member 133 held in the feed holder 107 are lifted up. In a case where the sheet is left on the manual feed tray, or in a case where the leading edge of the sheet is positioned upstream, in the sheet feeding direction, of the abutment position of the leading-edge positioning member 133, the leading-edge positioning member 133 and the lock member 134 are swung by their own weight and return to the initial state as illustrated in FIG. 13A.

Then, the configuration of absorbing the overload on the leading-edge positioning member 133 may be provided in the above-described configuration described using FIGS. 13A and 13B as follows. The lock member 134 includes the engagement portion 134*c* on an engaging side with respect to the leading-edge positioning member 133 in the regulation posture, and the retaining portion 134*d*, i.e., a held portion, which contains the pivotal shaft 135 as illustrated in FIG. 14. The engagement portion 134*c* and the retaining portion 134*d* are formed to make a space therebetween to provide a tension spring 169. The engagement portion 134*c* is supported to come into sliding contact with the retaining portion 134*d*.

With the use of the above lock member 134, when the impact is applied to the leading-edge positioning member 133 in the regulation posture, the tension spring 169 is extended to separate the engagement portion 134*c* from the retaining portion 134*d* in order to absorb the impact. In other words, when the overload is applied on the leading-edge positioning member 133, the tension spring 169 is extended, and releases the upper end claw portion 133*c* locked by the engagement claw portion 134*a* of the lock member 134 while absorbing the overload. The tension spring 169 (the resilient member) serves as a damper portion which absorbs the impact added from the manual feed tray 111 with respect to the leading-edge positioning member 133 which is locked in the regulation posture by the lock member 134.

With such a configuration, it is possible to prevent that the components are damaged during overloading and the sheet is buckled in the leading-edge positioning mechanism which includes the leading-edge positioning member 133 and the lock member 134, without being limited to the configurations as described in the first and second embodiments.

Other Embodiments

It is noted that in the first, second, and third embodiments, the spring materials such as the torsion coil spring 136, the compression spring 149, and the tension spring 169 are used as the damper portions, but the materials for the damper portion is not limited thereto. In addition, the descriptions in these embodiments have been made using the electrophotographic system image forming apparatus 201, and instead the present disclosure may be applied to an inkjet image forming apparatus which forms an image in a sheet by ejecting ink from a nozzle for example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-175816, filed on Sep. 7, 2015, which is hereby incorporated by reference herein in its entirety.

What is claimed is:

1. A sheet feeding apparatus comprising:

an apparatus body;

a supporting portion held by the apparatus body and configured to support a sheet;

a feed portion configured to feed the sheet supported on the supporting portion;

a conveyance portion disposed downstream of the feed portion in a sheet feeding direction;

a separation portion disposed in pressure contact with the conveyance portion and configured to separate sheets fed from the feed portion one by one in a separation nip portion formed between the conveyance portion and the separation portion;

a sheet regulation member disposed upstream of the separation nip portion in the sheet feeding direction, the sheet regulation member being configured to take a regulation position to regulate the sheet on the supporting portion so as not to enter the separation nip portion and a retracted position to allow the sheet on the supporting portion to enter the separation nip portion;

a restriction portion configured to restrict a change of the sheet regulation member from the regulation position to the retracted position;

a feed holder configured to hold the feed portion and pivotally supported by the apparatus body between an approach position where the feed portion approaches the supporting portion and a separation position where the feed portion is separated from the supporting portion with respect to the approach position;

an engagement member provided separately from the feed holder and configured to engage with the feed holder to move the feed holder; and a resilient member disposed between the engagement member and the feed holder, wherein in a case where an external force equal to or more than a predetermined amount is applied to the sheet regulation member in a state where the restriction portion restricts change of the sheet regulation member from the regulation position to the retracted position, the resilient member allows the feed holder to move with respect to the engagement member so that the sheet regulation member is displaced along with movement of the feed holder.

2. The sheet feeding apparatus according to claim 1, wherein the resilient member allows the sheet regulation member to change to the retracted position if the sheet regulation member is displaced by external force of an amount greater than the predetermined amount.

3. The sheet feeding apparatus according to claim 1, wherein the sheet regulation member is held by the feed holder such that the sheet regulation member rotates to the regulation position by its own weight if the feed holder pivots from the approach position to the separation position, and wherein the restriction portion is configured to contact a downstream part, in the sheet feeding direction, of the sheet regulation member in the regulation position so as to restrict the sheet regulation member from being changed to the retracted position.

4. The sheet feeding apparatus according to claim 1, further comprising:

a drive unit configured to drive the feed portion;

a cam configured to be rotated by a drive force from the drive unit; and a cam follower configured to swing along with rotation of the cam and to abut with the engagement member, wherein the feed holder is held at the separation position if the engagement member is pressed by the cam follower.

5. The sheet feeding apparatus according to claim 1, wherein the sheet regulation member comprises a regulating surface against which the sheet supported on the supporting portion abuts, and is held by the feed holder through a pivotal shaft about which the sheet regulation member pivots, wherein the restriction portion comprises a contact portion configured to abut against a surface opposite to the regulating surface of the sheet regulation member at a position between the pivotal shaft and a distal end portion of the sheet regulation member, and wherein in a case where the external force equal to or more than the predetermined amount is applied to the regulating surface of the sheet regulation member, the feed holder is moved about the contact portion as a fulcrum by a force applied to the feed holder through the pivotal shaft.

6. The sheet feeding apparatus according to claim 1, further comprising a biasing portion disposed between the apparatus body and the feed holder and configured to bias the feed holder toward the approach position, wherein a moment of force that is applied to the feed holder by the resilient member in a case where the resilient member starts to be elastically deformed is set to be greater than a moment of force applied to the feed holder by the biasing portion.

7. The sheet feeding apparatus according to claim 1, wherein the conveyance portion is a roller, and the feed holder pivots about a rotation axis of the roller, and wherein the resilient member is a torsion spring disposed coaxially on the rotation axis.

8. The sheet feeding apparatus according to claim 1, wherein the supporting portion is a manual feed tray configured to support the sheet to be fed by a manual feed.

9. A sheet feeding apparatus comprising:

an apparatus body;

a supporting portion held by the apparatus body and configured to support a sheet;

a feed portion configured to feed the sheet supported on the supporting portion;

a conveyance portion disposed downstream of the feed portion in a sheet feeding direction;

a separation portion disposed in pressure contact with the conveyance portion and configured to separate sheets fed from the feed portion one by one in a separation nip portion formed between the conveyance portion and the separation portion;

a sheet regulation member disposed upstream of the separation nip portion in the sheet feeding direction, the sheet regulation member being configured to take a regulation position to regulate the sheet on the supporting portion so as not to enter the separation nip portion and a retracted position to allow the sheet on the supporting portion to enter the separation nip portion;

a restriction portion configured to restrict change of the sheet regulation member from the regulation position to the retracted position; and a resilient member, wherein the restriction portion comprises a contact portion configured to contact with the sheet regulation member and a held portion pivotally held by the apparatus body, wherein the resilient member is disposed between the contact portion and the held portion, wherein the contact portion of the restriction portion is configured to abut against a downstream part of the sheet regulation member in the sheet feeding direction, and wherein the resilient member is deformed if an external force equal to or more than a predetermined amount is applied to the sheet regulation member, so as to allow the contact portion to be displaced by being pressed by the sheet regulation member.

10. The sheet feeding apparatus according to claim 9, wherein the resilient member is a compression spring disposed in a posture along the sheet feeding direction.

11. A sheet feeding apparatus comprising:

an apparatus body;

a supporting portion held by the apparatus body and configured to support a sheet;

a feed portion configured to feed the sheet supported on the supporting portion;

a conveyance portion disposed downstream of the feed portion in a sheet feeding direction;

a separation portion disposed in pressure contact with the conveyance portion and configured to separate sheets fed from the feed portion one by one in a separation nip portion formed between the conveyance portion and the separation portion;

a sheet regulation member disposed upstream of the separation nip portion in the sheet feeding direction, the sheet regulation member being configured to take a regulation position to regulate the sheet on the supporting portion so as not to enter the separation nip portion and a retracted position to allow the sheet on the supporting portion to enter the separation nip portion;

a restriction portion configured to restrict change of the sheet regulation member from the regulation position to the retracted position;

a resilient member; and a feed holder configured to hold the feed portion and pivotally supported by the apparatus body, wherein the restriction portion comprises a contact portion configured to contact the sheet regulation member and a held portion pivotally held by the feed holder, and wherein the resilient member is disposed between the contact portion and the held portion.

12. The sheet feeding apparatus according to claim 11, wherein the resilient member is deformed if an external force equal to or more than a predetermined amount is applied to the sheet regulation member, so as to allow the sheet regulation member to move with respect to the feed holder.

13. The sheet feeding apparatus according to claim 11, wherein the sheet regulation member comprises a regulating surface against which the sheet supported on the supporting portion abuts, a pivotal shaft pivotally supported by the feed holder, and a projecting portion disposed on an opposite side to a distal end portion of the regulating surface with respect to the pivotal shaft, and wherein the resilient member is a tension spring disposed between the feed holder and the projecting portion.

14. A sheet feeding apparatus comprising:

an apparatus body;

a supporting portion held by the apparatus body and configured to support a sheet;

a feed roller configured to feed the sheet supported on the supporting portion;

a conveyance roller disposed downstream of the feed roller in a sheet feeding direction;

a feed holder configured to hold the feed roller and pivotally supported by the apparatus body between an approach position where the feed roller approaches the supporting portion and a separation position where the feed roller is separated from the supporting portion with respect to the approach position;

an engagement member configured to engage with the feed holder to move the feed holder;

a resilient member disposed between the engagement member and the feed holder;

a separation roller disposed in pressure contact with the conveyance roller and configured to separate sheets fed from the feed roller one by one with a separation nip portion formed between the conveyance roller and the separation roller;

a sheet regulation member held by the feed holder and disposed upstream of the separation nip portion in the sheet feeding direction, the sheet regulation member being configured to take a regulation position to regulate the sheet on the supporting portion not to enter the separation nip portion and a retracted position to allow the sheet on the supporting portion to enter the separation nip portion; and a restriction portion configured to restrict change of the sheet regulation member from the regulation position to the retracted position in a state where the feed holder is at the separated position, and to release restriction of the sheet regulation member in the regulation position if the feed holder is rotated from the separation position to the approach position, wherein in a case where an external force equal to or more than a predetermined amount in the sheet feeding direction is applied to the sheet regulation member in a state where the sheet regulation member is restricted in the regulation position by the restriction portion, the resilient member is elastically deformed.

15. The sheet feeding apparatus according to claim 14, wherein if external force equal to or more than an allowable amount larger than the predetermined amount is applied to the sheet regulation member, the feed holder is rotated from the separation position toward the approach position so that the restriction of the sheet regulation member in the regulation position is released.

16. An image forming apparatus comprising:

the sheet feeding apparatus according to claim 14; and an image forming portion configured to form an image on the sheet fed from the sheet feeding apparatus.

17. A sheet feeding apparatus comprising:

an apparatus body;

a supporting portion held by the apparatus body and configured to support a sheet;

a feed portion configured to feed the sheet supported on the supporting portion;

a conveyance portion disposed downstream of the feed portion in a sheet feeding direction;

a separation portion disposed in pressure contact with the conveyance portion and configured to separate sheets fed from the feed portion one by one in a separation nip portion formed between the conveyance portion and the separation portion;

a sheet regulation member disposed upstream of the separation nip portion in the sheet feeding direction, the sheet regulation member being configured to take a regulation position to regulate the sheet on the supporting portion so as not to enter the separation nip portion and a retracted position to allow the sheet on the supporting portion to enter the separation nip portion;

a restriction portion configured to restrict change of the sheet regulation member from the regulation position to the retracted position by contacting the sheet regulating member at a contact point;

a holder pivotally holding the sheet regulation member and movable with respect to the apparatus body; and a resilient member disposed at the holder, wherein in a case where an external force equal to or more than a predetermined amount is applied to the sheet regulation member in a state where the restriction portion restricts change of the sheet regulation member from the regulation position to the retracted position, the holder is moved by the external force equal to or more than the predetermined amount while deforming the resilient member so that the sheet regulation member is displaced around the contact point as a fulcrum, and wherein in a case where an external force less than the predetermined amount is applied to the sheet regulation member in a state where the restriction portion restricts change of the sheet regulation member from the regulation position to the retracted position, the restriction portion resists against the external force less than the predetermined amount in contact with the sheet regulation member at the contact point so that change of the sheet regulation member from the regulation position to the retracted position is restricted.

* * * * *